US006378996B1

(12) United States Patent
Shimada et al.

(10) Patent No.: US 6,378,996 B1
(45) Date of Patent: Apr. 30, 2002

(54) INK-JET RECORDING HEAD AND INK-JET RECORDING APPARATUS

(75) Inventors: Masato Shimada; Akira Matsuzawa; Yoshinao Miyata; Tsutomu Nishiwaki, all of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/712,842

(22) Filed: Nov. 15, 2000

(30) Foreign Application Priority Data

Nov. 15, 1999 (JP) ..... 11-324616
Dec. 9, 1999 (JP) ..... 11-350873
Sep. 12, 2000 (JP) ..... 2000-275791

(51) Int. Cl.[7] ..... B41J 2/045
(52) U.S. Cl. ..... 347/70; 347/68
(58) Field of Search ..... 347/68–72, 20

(56) References Cited

U.S. PATENT DOCUMENTS 5,265,315 A 11/1993 Hoisington et al. ..... 29/25.35

FOREIGN PATENT DOCUMENTS

| | | | | |
|---|---|---|---|---|
| EP | 0 800 920 A2 | | 10/1997 | ..... B41J/2/14 |
| EP | 0 925 923 A1 | | 6/1999 | ..... B41J/2/045 |
| JP | 401257057 A | * | 10/1989 | ..... 347/70 |
| JP | 3-295655 | | 12/1991 | ..... B41J/2/045 |
| JP | 5-286131 | | 11/1993 | ..... B41J/2/045 |
| JP | 11-78003 | | 3/1999 | ..... B41J/2/045 |
| JP | 2000-289201 | | 10/2000 | ..... B41J/2/045 |

OTHER PUBLICATIONS

European Search Report.
Patent Abstracts of Japan 03295655 Dec. 26, 1991.
Patent Abstracts of Japan 11078003 Mar. 23, 1999.
Patent Abstracts of Japan 05286131 Nov. 2, 1993.
Patent Abstract 5–286131 Nov. 2, 1993

* cited by examiner

*Primary Examiner*—John Barlow
*Assistant Examiner*—An H. Do
(74) *Attorney, Agent, or Firm*—Sughrue Mion, PLLC

(57) ABSTRACT

Disclosed are an ink-jet recording head in which rigidity of a compartment wall is improved and pressure generating chambers are arranged in a high density, a manufacturing method and an ink-jet recording apparatus thereof.

An ink-jet recording head includes: a passage-forming substrate 10 having at least silicon layer that consists of single crystal silicon and pressure generating chambers 12 defined thereon, which communicate with a nozzle orifice 21; and a piezoelectric element 300 for generating a pressure change in the pressure generating chamber 12, the piezoelectric element 300 being provided in a region opposite the pressure generating chamber 12 via a vibration plate, which constitutes a portion of the pressure generating chamber 12. The ink-jet recording head further includes a joining plate 20 joined to the passage-forming substrate 10 on the surface where the piezoelectric element 300 is formed, and the nozzle orifice 21 is provided on the joining plate 20.

27 Claims, 20 Drawing Sheets

(a)

(b)

(a)

(b)

INK-JET RECORDING HEAD AND INK-JET RECORDING APPARATUS

BACKGROUND OF THE INVENTION

The present invention relates to an ink-jet recording head, in which a portion of a pressure generating chamber communicating with a nozzle orifice that ejects ink droplets is constituted of a vibration plate, a piezoelectric element is provided via this vibration plate, and ink droplets are ejected by displacement of the piezoelectric element. Furthermore, the present invention relates to an ink-jet recording apparatus.

With regard to the ink-jet recording head, in which a portion of a pressure generating chamber communicating with a nozzle orifice that ejects ink droplets is constituted of a vibration plate, this vibration plate is deformed by a piezoelectric element to pressurize ink in the pressure generating chamber, and ink droplets are ejected from the nozzle orifice, two types of recording heads are put into practical use. One is a recording head using a piezoelectric actuator of longitudinal vibration mode that expands and contracts in the axis direction of the piezoelectric element, and the other one uses a piezoelectric actuator of flexural vibration mode.

The former one can change the volume of the pressure generating chamber by abutting the end surface of the piezoelectric element against the vibration plate, and manufacturing of a head suitable to high density printing is enabled. On the contrary, a difficult process in which the piezoelectric element is cut and divided in a comb tooth shape to make it coincide with the array pitch of the nozzle orifice and a method so that the cut and divided piezoelectric element is aligned and fixed to the pressure generating chamber is necessary, thus there is a problem of a complex manufacturing process.

On the other hand, in the latter, the piezoelectric element can be fabricated and installed on a vibration plate by a relatively simple process in which a green sheet, which is piezoelectric material, is adhered while fitting the shape thereof to the pressure generating chamber shape and is sintered. However, a certain size of vibration plate is required due to the usage of flexural vibration, thus there is a problem that a high density array of the piezoelectric elements is difficult.

In order to solve such a disadvantage of the latter recording head, as shown in Japanese Patent Laid-Open No. 5-286131, a recording head is proposed, in which an even piezoelectric material layer is formed across the entire surface of the vibration plate by a deposition technology, the piezoelectric material layer is cut and divided into a shape corresponding to the pressure generating chamber by a lithography method, and the piezoelectric element is formed so as to be independent of another piezoelectric element for each pressure generating chamber.

According to the above-described process, a method for adhering the piezoelectric element on the vibration plate is unnecessary, and there is an advantage that not only the piezoelectric element can be fabricated and installed by accurate and simple means, lithography method, but also the thickness of the piezoelectric element can be made thin and a high-speed drive is enabled.

In such an inkjet printing head, because the pressure generating chamber is formed so as to penetrate in the thickness direction of the head by performing etching from the substrate surface opposite that having the piezoelectric element made thereon or other processing, a pressure generating chamber with a high dimension accuracy can be arranged relatively easily in a high density.

However, in such an ink-jet recording head, in the case where a relatively large substrate having a diameter, for example, of about 6 to 12 inches is used for forming the pressure generating chamber, the thickness of the substrate needs to be made thick due to the problem of handling, and the depth of the pressure generating chamber becomes deeper accompanied with the thickness of the substrate. Therefore, a sufficient rigidity cannot be obtained unless the thickness of compartment walls that divide the pressure generating chambers is made thicker, thus there is a problem that cross talk occurs and a desired ejection characteristic cannot be obtained. In addition, if the compartment wall thickness is made thicker, nozzles cannot be arranged in a high array density, thus there is a problem that a printing quality of high resolution cannot be achieved.

SUMMARY OF THE INVENTION

The object of the present invention, in consideration of the foregoing circumstance, is to provide an ink-jet recording head that is capable of improving the rigidity of the compartment wall and of arranging the pressure generating chambers in a high density, and an ink-jet recording apparatus.

A first aspect of the present invention for solving the above-described problem is an ink-jet recording head that comprises a passage-forming substrate comprising at least silicon layer that consists of single crystal silicon and pressure generating chambers defined thereon, which communicate with a nozzle orifice, and a piezoelectric element for generating a pressure change in the pressure generating chamber, the piezoelectric element being provided in a region opposite to the pressure generating chamber via a vibration plate, which constitutes a portion of the pressure generating chamber. The ink-jet recording head is characterized in that it further comprises a joining plate joined to the passage-forming substrate on the surface where the piezoelectric element is formed, and the nozzle orifice is provided on the joining plate.

In the first aspect, the nozzle orifice can be easily formed even if the pressure generating chambers are formed without penetrating the passage-forming substrate. Therefore, the pressure generating chamber can be formed relatively shallowly, and the rigidity of the compartment walls dividing the pressure generating chambers is improved.

A second aspect of the ink-jet recording head of the present invention according to the first aspect is characterized in that an integrated circuit is formed on the joining plate.

In the second aspect, the integrated circuit is formed on the joining plate joined to the passage-forming substrate, thus the manufacturing process of the ink-jet recording head can be simplified and the number of parts can be reduced, leading to reduction in cost.

A third aspect of the ink-jet recording head of the present invention according to the first or second aspect is characterized in that the joining plate is a sealing plate that includes a piezoelectric element holding portion capable of sealing a space in a state where the space is secured for the piezoelectric element such that the movement thereof is not interfered with, in a region opposite to the piezoelectric element.

In the third aspect, a break of the piezoelectric element due to external environment is prevented.

A fourth aspect of the ink-jet recording head of the present invention according to the second or third aspect is characterized in that the integrated circuit is a driving circuit for driving the piezoelectric element.

In the fourth aspect, the driving circuit for driving the piezoelectric element can be formed relatively easily.

A fifth aspect of the ink-jet recording head of the present invention according to the second or third aspect is characterized in that the integrated circuit is a temperature detecting means for detecting a temperature of a head or a temperature control circuit for controlling the temperature.

In the fifth aspect, the temperature detecting means or the temperature control circuit can be formed relatively easily.

A sixth aspect of the ink-jet recording head of the present invention according to the second or third aspect is characterized in that the integrated circuit is an ejection number detecting means for detecting the ejection number of ink droplets that are ejected from the nozzle orifice.

In the sixth aspect, the ejection number detecting means can be formed relatively easily.

A seventh aspect of the ink-jet recording head of the present invention according to the third aspect is characterized in that the integrated circuit is a humidity control circuit for performing control of humidity detecting means for detecting humidity of the piezoelectric element holding portion.

In the seventh aspect, the humidity control circuit can be formed relatively easily.

An eighth aspect of the ink-jet recording head of the present invention according to any one of the second to seventh aspects is characterized in that the integrated circuit is provided on the opposite surface with the joining surface of the joining plate with the passage-forming substrate.

In the eighth aspect, wiring of the integrated circuit can be taken out at the surface of the joining plate.

A ninth aspect of the ink-jet recording head of the present invention according to any one of the second to seventh aspects is characterized in that the integrated circuit is provided on the joining surface of the joining plate with the passage-forming substrate, and the piezoelectric element and the integrated circuit are electrically connected by flip chip mounting.

In the ninth aspect, by joining the passage-forming substrate and the joining plate, the integrated circuit and the piezoelectric element can be directly connected.

A tenth aspect of the ink-jet recording head of the present invention according to the ninth aspect is characterized in that connection wiring is formed to connect the integrated circuit and external wiring, and the integrated circuit and the connection wiring are electrically connected by flip chip mounting.

In the tenth aspect, by joining the passage-forming substrate and the joining plate, the integrated circuit and the connection wiring can be directly connected.

An eleventh aspect of the ink-jet recording head of the present invention according to the ninth aspect or tenth aspect is characterized in that the integrated circuit and the piezoelectric element or the connection wiring are connected by an anisotropic conductive material(e.g. anisotropic conductive film).

In the eleventh aspect, the integrated circuit and the piezoelectric element or the connection wiring can be connected relatively easily and accurately.

A twelfth aspect of the ink-jet recording head of the present invention according to any one of the first to eleventh aspects is characterized in that the joining plate consists of a single crystal silicon substrate.

In the twelfth aspect, the integrated circuit can be formed on the joining plate relatively easily and integrally with good precision.

A thirteenth aspect of the ink-jet recording head of the present invention according to any one of the first to twelfth aspects is characterized in that the pressure generating chamber is formed on one surface of the passage-forming substrate without penetrating the passage-forming substrate, and a reservoir for supplying ink to the pressure generating chamber is formed on the other surface of the passage-forming substrate.

In the thirteenth aspect, the pressure generating chamber can be formed relatively shallowly, and the rigidity of the compartment wall dividing the pressure generating chambers is improved. Moreover, a reservoir with a sufficiently large volume relative to that of the pressure generating chamber is provided, and changes in inner pressure are absorbed by ink itself in the reservoir.

A fourteenth aspect of the ink-jet recording head of the present invention according to the thirteenth aspect is characterized in that the reservoir directly communicates with the pressure generating chamber.

In the fourteenth aspect, ink is directly supplied from the reservoir to each pressure generating chamber.

A fifteenth aspect of the ink-jet recording head of the present invention according to the thirteenth aspect is characterized in that an ink communicating path communicating with one end portion in the longitudinal direction of the pressure generating chamber is formed on one surface of the passage-forming substrate, and the reservoir communicates with the ink communicating path.

In the fifteenth aspect, because ink is supplied from the reservoir to each pressure generating chamber through the ink communicating path, ink resistance can be controlled at a narrowed portion in spite of variation of a sectional area of a communicating portion between the reservoir and the ink communicating path, thus variation of ink ejection characteristic among the pressure generating chambers can be reduced.

A sixteenth aspect of the ink-jet recording head of the present invention according to the fifteenth aspect is characterized in that an ink communicating path is provided for each pressure generating chamber.

In the sixteenth aspect, ink is supplied from the reservoir to each pressure generating chamber through the ink communicating path provided for each pressure generating chamber.

A seventeenth aspect of the ink-jet recording head of the present invention according to the fifteenth aspect is characterized in that the ink communicating path is continuously provided across the direction where the pressure generating chambers are parallelly provided.

In the seventeenth aspect, ink is supplied from the reservoir to each pressure generating chamber through a common ink communicating path.

An eighteenth aspect of the ink-jet recording head of the present invention according to any one of the thirteenth to seventeenth aspects is characterized in that a nozzle communicating path communicating the pressure generating chamber with the nozzle orifice is provided at the end portion opposite to the reservoir in the longitudinal direction of the pressure generating chamber.

In the eighteenth aspect, ink is stably supplied from the reservoir to the pressure generating chamber, and ink is excellently ejected from the nozzle orifice.

A nineteenth aspect of the ink-jet recording head of the present invention according to the eighteenth aspect is characterized in that the nozzle communicating path is formed by removing the vibration plate.

In the nineteenth aspect, the nozzle communicating path can be easily formed.

A twentieth aspect of the ink-jet recording head of the present invention according to the eighteenth or nineteenth aspect is characterized in that the inner surface of the nozzle communicating path is covered with an adhesive agent.

In the twentieth aspect, peeling off of the vibration plate due to ink flow through the nozzle communicating path is prevented.

A twenty-first aspect of the ink-jet recording head of the present invention according to any one of the first to twentieth aspects is characterized in that the passage-forming substrate consists only of a silicon layer.

In the twenty-first aspect, the pressure generating chamber is defined only by the silicon layer.

A twenty-second aspect of the ink-jet recording head of the present invention according to any one of the first to twentieth aspects is characterized in that the passage-forming substrate consists of an SOI substrate having silicon layers on both surfaces of an insulation layer.

In the twenty-second aspect, patterning for the pressure generating chamber, the reservoir, or the like can be performed relatively easily with good precision.

A twenty-third aspect of the ink-jet recording head of the present invention according to any one of the first to twentieth aspects is characterized in that the passage-forming substrate consists of a substrate having at least silicon layers on both surfaces of a boron doped silicon layer.

In the twenty-third aspect, patterning for the pressure generating chamber, reservoir, or the like can be performed relatively easily with good precision.

A twenty-fourth aspect of the ink-jet recording head of the present invention according to any one of the first to twenty-third aspects is characterized in that the plane orientation of the silicon layer that consists of the passage-forming substrate is a (100) plane.

In the twenty-fourth aspect, the reservoir or the like can be formed with high precision also by wet etching.

A twenty-fifth aspect of the ink-jet recording head of the present invention according to the twenty-fourth aspect is characterized in that the lateral cross-sectional surface of the pressure generating chamber has an approximately triangular shape.

In the twenty-fifth aspect, because the rigidity of the compartment wall between the pressure generating chambers is significantly improved, the pressure generating chambers can be arranged in a high density, and cross talk can be prevented.

A twenty-sixth aspect of the ink-jet recording head of the present invention according to any one of the first to twenty-fifth aspects is characterized in that the pressure generating chamber is formed by anisotropic etching, and each layer that constitutes the vibration plate and the piezoelectric element is formed by a deposition and lithography method.

In the twenty-sixth aspect, the ink-jet recording head having the nozzle orifices in a high density can be manufactured relatively easily in a large amount.

A twenty-seventh aspect of the present invention is characterized in that the ink-jet recording apparatus comprises the ink-jet recording head according to any one of the first to twenty-sixth aspects.

In the twenty-seventh aspect, the ink-jet recording apparatus having an improved ink ejection characteristic of the head and a high density thereof can be realized.

BRIEF DESCRIPTION OF THE DRAWINGS

For a more complete understanding of the present invention and the advantages thereof, reference is now made to the following descriptions in conjunction with the accompanying drawings.

FIG. 2(*a*) is a cross-sectional view of FIG. 1; and FIGS. 2(*b*) and 2(*c*) are plan views thereof.

DESCRIPTION OF THE PREFERRED EMBODIMENTS

The present invention will be described in detail based on the embodiments below.

(Embodiment 1)

Figure 1:
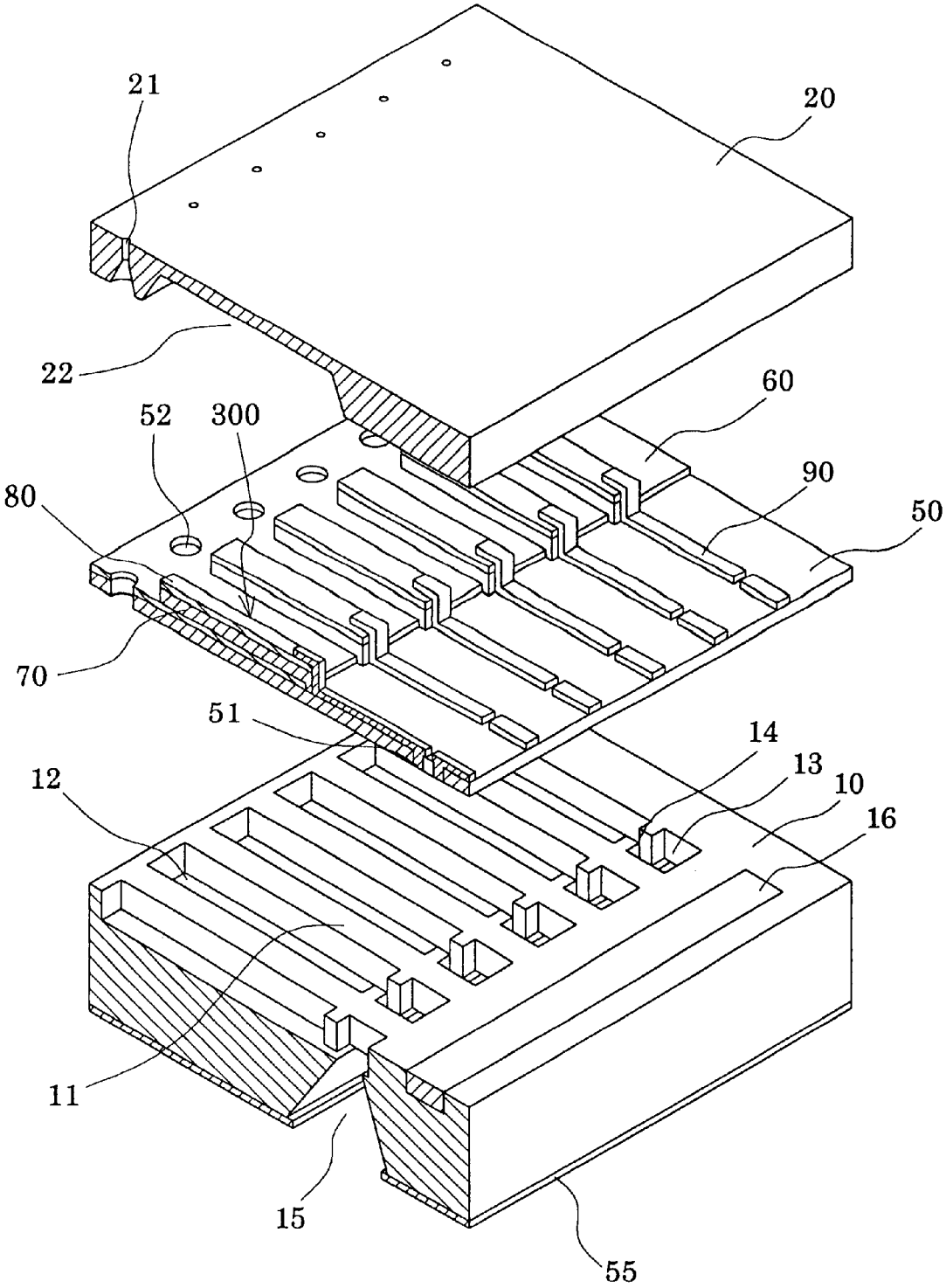
FIG. 1 is a perspective view showing an outline of the ink-jet recording head according to embodiment 1 of the present invention.
Figure 2:
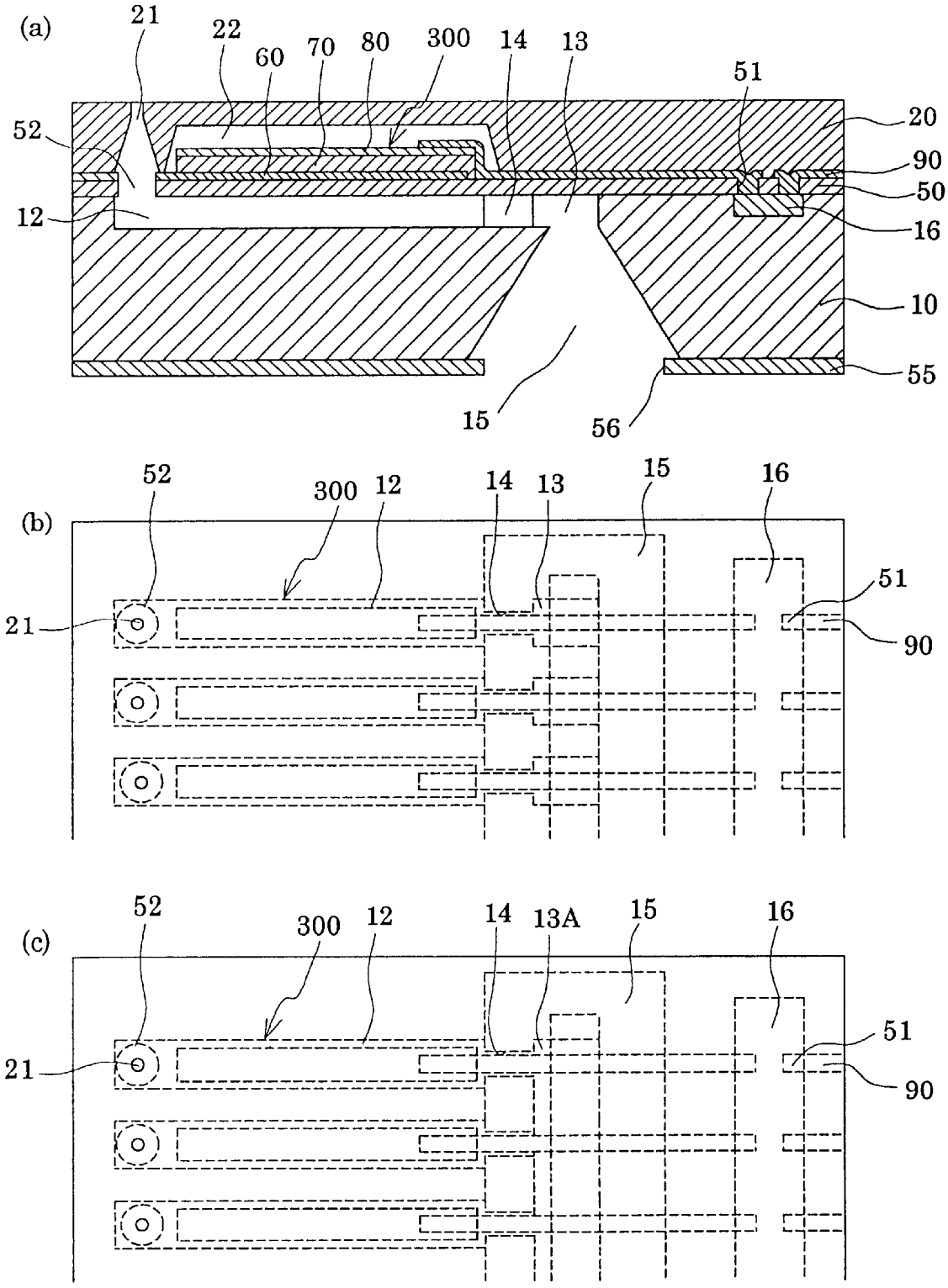
FIGS. 2(*a*) to 2(*c*) are views showing the ink-jet recording head according to embodiment 1 of the present invention.

FIG. 1 is an exploded perspective view showing the inkjet recording head according to embodiment 1 of the present invention. FIGS. 2(*a*) to 2(*c*) are a cross-sectional view and plan views of the ink-jet recording head in the longitudinal direction of the pressure generating chamber.

As shown in the drawings, a passage-forming substrate 10 having pressure generating chambers 12 formed thereon has a thickness of, for example, 150 μm to 1 mm, and consists of a single crystal silicon substrate having a plane (100) of the plane orientation. On the surface layer portion of one surface thereof, the pressure generating chambers 12 divided by a plurality of compartment walls 11 are formed by anisotropic etching.

On one end portion of the longitudinal direction of each pressure generating chamber 12, an ink communicating portion 13, which is an intermediate chamber for connecting a reservoir 15 (to be described later) and the pressure generating chamber 12, are communicated via a narrowed portion 14 having a width narrower than that of the pressure generating chamber 12. The ink communicating portion 13 and the narrowed portion 14 are also formed by anisotropic etching together with the pressure generating chamber 12. Note that the narrowed portion 14 is made to control the in and out flow of ink.

In performing the anisotropic etching, either a wet etching method or a dry etching method can be used. By performing etching halfway (half etching) in the thickness direction of the single crystal silicon substrate, the pressure generating chamber 12 is shallowly formed. The depth of the pressure generating chamber 12 can be adjusted by controlling etching time of the half etching.

Note that, in the present embodiment, the ink communicating portion 13 is provided for each pressure generating chamber 12. But, not being limited to this, for example, as shown in FIG. 2(*c*), an ink communicating portion 13A may be made so as to communicate with all the pressure generating chambers 12 via the narrowed portions 14. In this case, the ink communicating portion 13A may also constitute a portion of the reservoir 15 that will be described later.

On the other surface of the passage-forming substrate 10, the reservoir 15 that communicates with each ink communicating portion 13 and supplies ink to each pressure generating chamber 12 is formed. The reservoir 15 is formed with a specified mask by anisotropic etching, which is wet etching in the present embodiment. Since the reservoir 15 is formed by wet etching in the present embodiment, the reservoir 15 has a shape in that the area of the opening becomes larger closer to the other surface of the passage-forming substrate 10. Thus, the volume of the reservoir 15 is large enough in comparison with the volume of all the pressure generating chambers 12 supplying ink.

Note that, in the present embodiment, because the single crystal silicon substrate having a plane (100) of the plane orientation is used as the passage-forming substrate 10, the reservoir 15 or the like can be formed with good precision also by wet etching.

In addition, in the vicinity of the end portion of the passage-forming substrate 10, a specified integrated circuit, which is drive circuit 16 for driving a piezoelectric element 300 in the present embodiment, is integrally formed across the direction where the pressure generating chambers 12 are parallelly provided.

On such a passage-forming substrate 10, an elastic film 50 having a thickness of 1 to 2 μm, which consists of an insulation layer, for example, zirconium oxide ($ZrO_2$), is provided. One surface of the elastic film 50 constitutes one wall surface of the pressure generating chamber 12.

In a region opposite to each pressure generating chamber 12 on such elastic film 50, a lower electrode film 60 with a thickness, for example, of about 0.5 μm, a piezoelectric layer 70 with a thickness, for example, of about 1 μm and an upper electrode film 80 with a thickness, for example, of about 0.1 μm are formed in a laminated state by a process (to be described later), which constitutes the piezoelectric element 300. Herein, the piezoelectric element 300 indicates a portion that includes the lower electrode film 60, the piezoelectric layer 70 and the upper electrode film 80. Generally, the piezoelectric element 300 is constituted such that any one of the electrodes of the piezoelectric element 300 is made to be a common electrode, and that the other electrodes and the piezoelectric layer 70 are subjected to patterning for each pressure generating chamber 12. And, in this case, a portion that is constituted of any one of the electrodes and the piezoelectric layer 70, to which patterning is performed, and where a piezoelectric distortion is generated by application of a voltage to the both electrodes is referred to as a piezoelectric active portion. In the present embodiment, the lower electrode film 60 is made to be a common electrode of the piezoelectric element 300, and the upper electrode film 80 is made to be an individual electrode. However, no problem occurs even if this is reversed due to convenience of the drive circuit or wiring. In any case, the piezoelectric active portion is formed for each pressure generating chamber. In this embodiment, the piezoelectric element 300 and the elastic film 50 where displacement occurs by a drive of the piezoelectric element 300 are referred to as piezoelectric actuator in combination.

Moreover, lead electrodes 90 are respectively provided so as to extend onto the elastic film 50 between the upper electrode films 80 of the respective piezoelectric elements 300 and the drive circuit 16 integrally provided on the passage-forming substrate 10. The lead electrodes 90 and the drive circuit 16 are electrically connected respectively through connection holes 51 provided in a region, which opposes the drive circuit 16, of the elastic film 50.

In addition, in the vicinity of the end portion opposite to the ink communicating portion 13 in the longitudinal direction of the pressure generating chamber 12, nozzle communicating holes 52 that communicates with nozzle orifices 21 (to be described later) is provided for each pressure generating chamber 12 by removing the elastic film 50 and the lower electrode film 60.

On the elastic film 50 and the lower electrode film 60, on which the piezoelectric element 300 is formed, as shown in FIG. 1 and FIG. 2, a nozzle plate 20 is provided, where the nozzle orifices 21 are bored so as to communicate with the respective pressure generating chambers 12 through the nozzle communicating holes 52. This nozzle plate 20 consists of, for example, a single crystal silicon substrate, and a piezoelectric element holding portion 22 capable of hermetically sealing a space in a state where the space is secured for the piezoelectric element 300 such that the movement thereof is not interfered with, is provided in a region of the nozzle plate 20, which is opposite to the piezoelectric element 300. The piezoelectric element 300 is hermetically sealed in the piezoelectric element holding portion 22.

Herein, the size of the pressure generating chamber 12 that applies ink droplet ejection pressure to the ink and the size of the nozzle orifice 21 that ejects ink droplets are optimized according to the amount of ejected ink droplets, ejection speed and ejection frequency thereof. For example, in the case where 360 droplets per 1 inch are recorded, the nozzle orifice 21 is required to be formed in several tens of micrometers in diameter with good precision.

Such a nozzle plate 20 is fixed on the elastic film 50 and the lower electrode film 60 with adhesive agent or the like. At this time, it is preferable that the inner surface of the nozzle communicating hole 52, which is formed on the elastic film 50 and the lower electrode film 60, be covered with the adhesive agent. Thus, the inner surface of the ink communicating hole 52 is protected, and peeling off and the like of the elastic film 50 or the lower electrode film 60 can be prevented.

As described above, in the present embodiment, because the nozzle plate 20 where the nozzle orifices 21 are bored is provided on the surface of the passage-forming substrate 10 where the piezoelectric elements 300 are formed, the pressure generating chamber 12 may be formed without penetrating the passage-forming substrate 10. Therefore, the pressure generating chamber 12 can be formed to be relatively thin to improve rigidity of the compartment wall 11 that divides the pressure generating chambers, and a plurality of the pressure generating chambers 12 can be arrayed in a high density. Moreover, compliance of the compartment wall 11 becomes small, thus the ejection characteristic of ink improves.

Since the thickness of the passage-forming substrate 10 also can be made relatively thick, handling becomes easy even if the size of a wafer is made to be large. Therefore, the number of chips taken out per one wafer can be increased, and manufacturing cost thereof can be reduced. Moreover, because the chip size also can be made larger, a head of a long size can be manufactured. Furthermore, occurrence of warp of the passage-forming substrate is suppressed, which brings easy positioning thereof when joining with other members. Even after the joining, characteristic change of the piezoelectric element is suppressed to stabilize the ink ejection characteristic.

In the present embodiment, the pressure generating chamber 12 is formed on the surface layer portion of one surface of the passage-forming substrate 10, and the reservoir 15 communicating with each pressure generating chamber 12 is formed on the other surface. Accordingly, the volume of the reservoir 15 can be formed to be large enough in comparison with the volume of the pressure generating chambers 12, which enables the ink itself in the reservoir 15 to have compliance. Therefore, there is no need to separately provide a substrate or the like for absorbing the pressure change in the reservoir 15, thus the structure of the recording head can be simplified and the manufacturing cost thereof can be reduced.

Although the manufacturing method of such an ink-jet recording head is not specifically limited, it can be formed in the process as described below.

Figure 3:
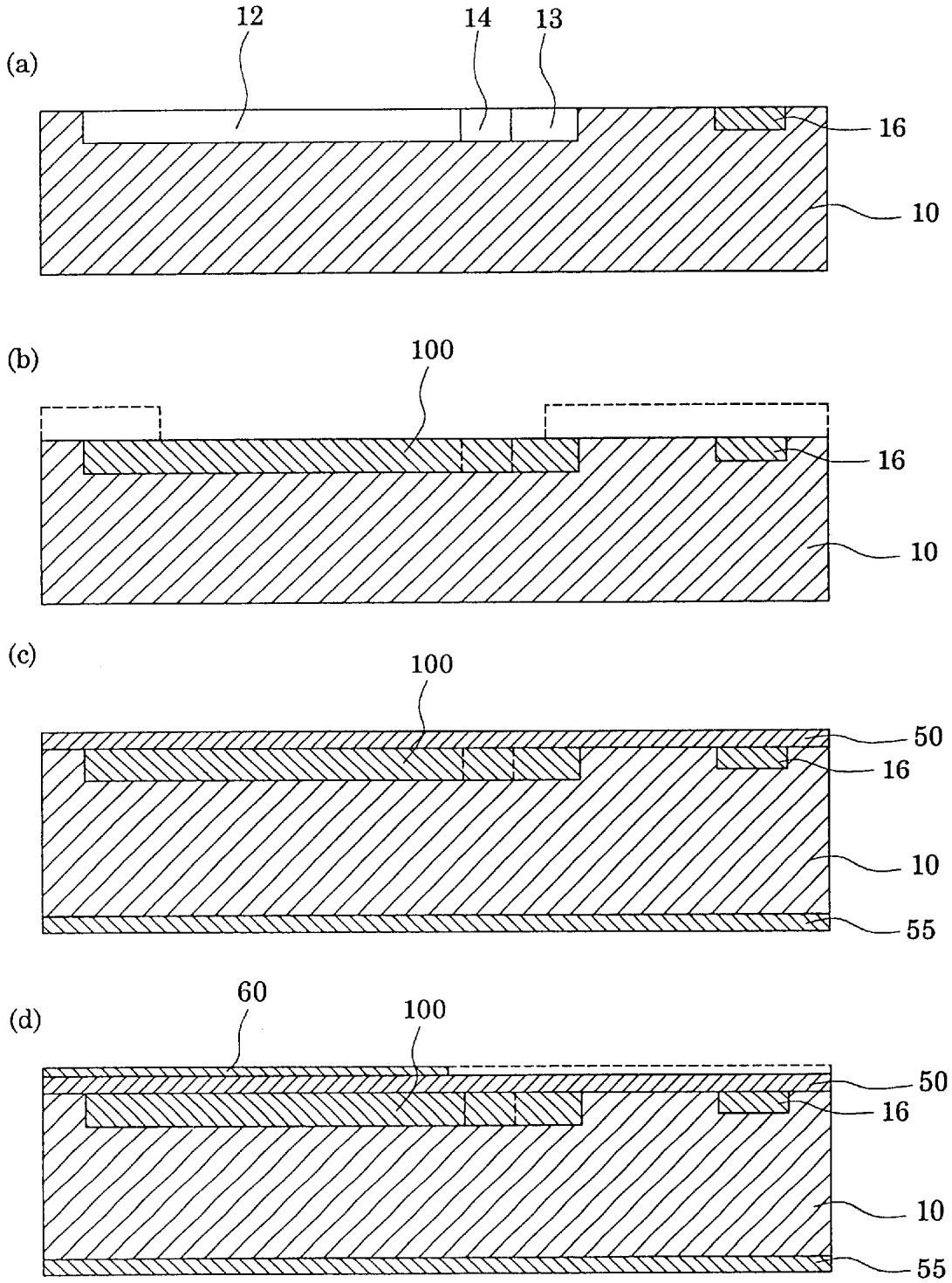
FIGS. 3(*a*) to 3(*d*) are cross-sectional views showing the manufacturing process of the ink-jet recording head according to embodiment 1 of the present invention.

Firstly, as shown in FIG. 3(*a*), on one surface of the single crystal silicon substrate that becomes the passage-forming substrate 10, the anisotropic etching is performed by using a mask of a specified shape that consists of, for example, silicon oxide, thus the pressure generating chamber 12, the ink communicating portion 13 and the narrowed portion 14 are formed. Note that the drive circuit 16 for driving the piezoelectric element was previously formed integrally on the passage-forming substrate 10 by, for example, a semiconductor manufacturing process.

Secondly, as shown in FIG. 3(*b*), a sacrificial layer 100 is filled in the pressure generating chamber 12, the ink communicating portion 13 and the narrowed portion 14 that are formed on the passage-forming substrate 10. For example in the present embodiment, the sacrificial layer 100 is formed across the entire surface of the passage-forming substrate 10 in a thickness approximately equal to the depth of the pressure generating chamber 12. Then, the sacrificial layer 100 formed on the region other than the pressure generating chamber 12, the ink communicating portion 13 and the narrowed portion 14 is removed by a chemical mechanical polish (CMP), thus forming the sacrificial layer 100.

Although the material of such a sacrificial layer 100 is not specifically limited, for example, polysilicon, phosphorous silicate glass (PSG) or the like may be used. In the present embodiment, PSG having a relatively fast etching rate is used.

Note that the manufacturing method of the sacrificial layer 100 is not specifically limited. For example, a method called gas deposition (or called jet molding) in which ultra-fine particles of 1 $\mu$m or less in diameter are made to collide with a substrate by the pressure of gas such as helium (He) at a high speed to deposit a film may be used. By this method, the sacrificial layer 100 can be partially formed on the only region corresponding to the pressure generating chamber 12, the ink communicating portion 13 and the narrowed portion 14.

Subsequently, as shown in FIG. 3(*c*), the elastic film 50 is formed on the passage-forming substrate 10 and the sacrificial layer 100. In the present embodiment, on the other surface of the passage-forming substrate 10, a protective film 55, which becomes a mask when the reservoir 15 is formed, is formed. For example in the present embodiment, after zirconium layers are formed on the both surfaces of the passage-forming substrate 10, thermal oxidation is performed thereof in a diffusion furnace at 500 to 1200° C. to form the elastic film 50 and the protective film 55 that consist of zirconium oxide.

The material of the elastic film 50 and the protective film 55 is not specifically limited, and it is satisfactory that the material is not etched in the step of forming the reservoir 15 and in the step of removing the sacrificial layer 100. In addition, the elastic film 50 and the protective film 55 may be formed of different materials. Further, the protective film 55 may be formed in any step if the forming is performed before the reservoir 15 is formed.

Next, the piezoelectric element 300 is formed on the elastic film 50 so as to correspond to each pressure generating chamber 12.

With regard to the process of forming the piezoelectric element 300, as shown in FIG. 3(*d*), firstly, the lower electrode film 60 is formed by sputtering across the entire surface of the passage-forming substrate 10 on the surface where the pressure generating chambers 12 are formed, and subjected to patterning in a specified shape. As a material of the lower electrode film 60, platinum, iridium or the like is preferable. This is because the piezoelectric layer 70 (to be described later), which is deposited by a sputtering method or a sol-gel method, is required to be sintered in 600 to 1000° C. under the atmosphere or an oxygen atmosphere to be crystallized after the film is deposited. In other words, the material of the lower electrode film 60 must maintain conductivity under such high temperature and oxidization atmosphere, specifically when lead zirconium titanate (PZT) is used as the piezoelectric layer 70, change in conductivity due to diffusion of lead oxide is desirably small. For these reasons, platinum and iridium are preferable.

Figure 4:
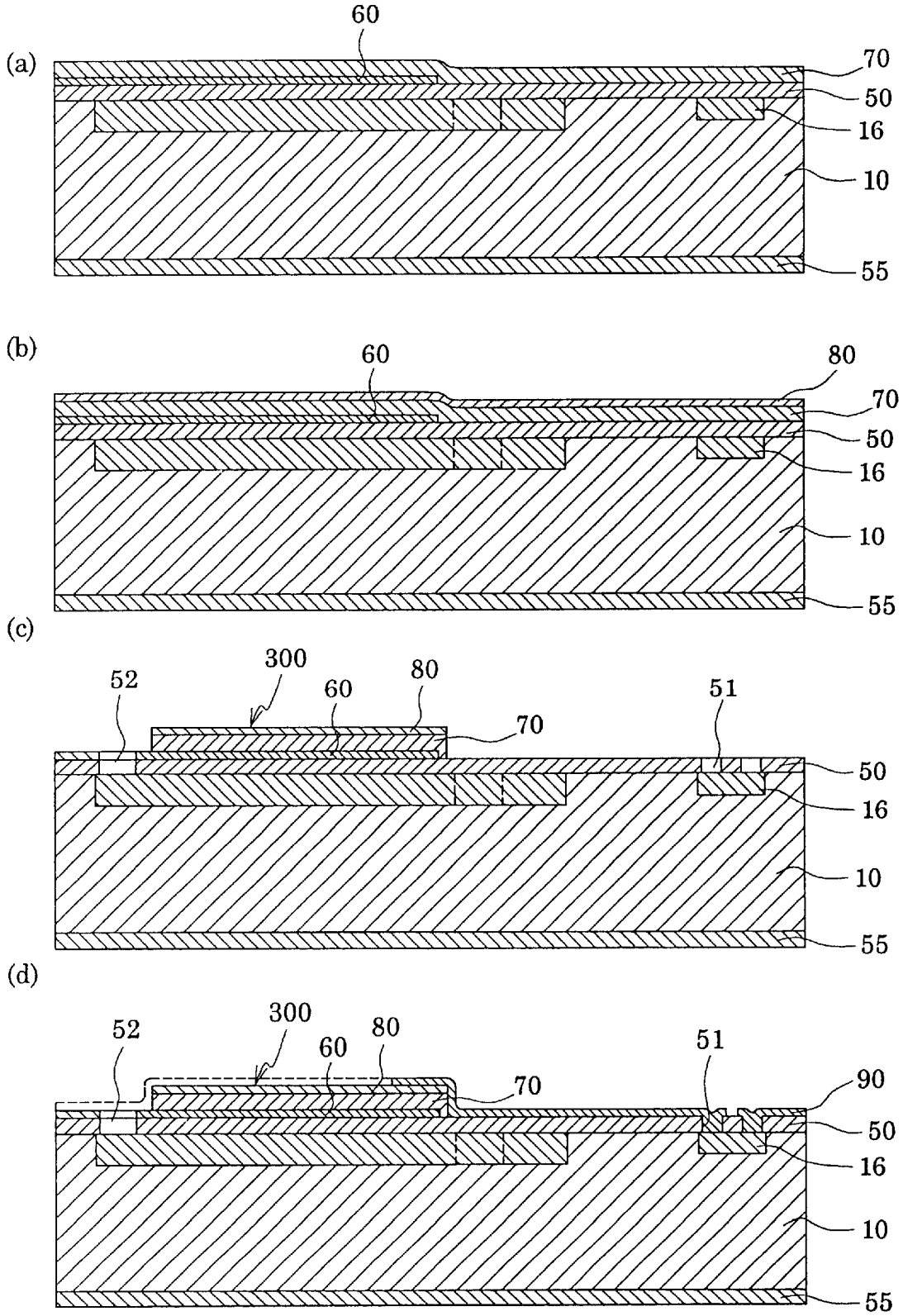
FIGS. 4(*a*) to 4(*d*) are cross-sectional views showing the manufacturing process of the inkjet recording head according to embodiment 1 of the present invention.

Next, as shown in FIG. 4(*a*), the piezoelectric layer 70 is deposited. For example in the present embodiment, a so-called sol-gel method is used to form the piezoelectric layer 70. In the sol-gel method, a so-called sol obtained by dissolving/dispersing metal organic material into a catalyst is coated and dried in a gel state, and then is sintered at a high temperature. Thus, the piezoelectric layer 70 that consists of metal oxide is obtained. As a material of the piezoelectric layer 70, a PZT series material is preferred when it is used in the ink-jet recording head. Note that the deposition method of the piezoelectric layer 70 is not specifically limited. For example, the deposition may be performed by a sputtering method or a spin coat method such as the an MOD method (metal organic deposition method).

Moreover, after a precursor film of lead zirconium titanate is formed by the sol-gel method, the sputtering method, the MOD method or the like, a method may be used, in which the film is made to undergo crystal growth at a low temperature in alkali water solution by a high pressure processing method.

In any case, the piezoelectric layer 70 that is deposited as described above, unlike bulk piezoelectric, has its crystals subjected to preferred orientation, and in the present embodiment, the crystals of the piezoelectric layer 70 are formed in a column shape. Note that the preferred orientation means a state where the orientation direction of crystals is not in disorder but a specific crystal surface faces substantially in the same direction. A thin film having column-shaped crystals means a state where approximately column-shaped crystals gather across the surface direction to deposit the thin film while the center axes of the crystals are approximately conformed to the thickness direction of the thin film. Of course, the thin film may be formed of grain-shaped crystals subjected to the preferred orientation. Note that the thickness of the piezoelectric layer 70 that is manufactured by such thin film manufacturing process is generally 0.2 to 5 $\mu$m.

Next, as shown in FIG. 4(*b*), the upper electrode film 80 is deposited. It is satisfactory that the upper electrode film 80 is made of a material with high conductivity, and various kinds of metals such as aluminum, gold, nickel, platinum or conductive oxide can be used. In the present embodiment, platinum is deposited by sputtering.

Subsequently, as shown in FIG. 4(*c*), only the piezoelectric layer 70 and the upper electrode film 80 are etched to perform patterning of the piezoelectric element 300. In the present embodiment, the elastic film 50 on the region opposite the drive circuit 16 is removed at the same time when the above patterning is performed, thus the connection hole 51 that becomes the connection portion with each piezoelectric element 300 is formed, and patterning is performed for the elastic film 50 and the lower electrode film 60 in the vicinity of the end portion opposite to the ink communicating portion 13 in the longitudinal direction of the pressure generating chamber 12, thus forming the nozzle communicating hole 52.

Next, as shown in FIG. 4(*d*), the lead electrode 90 is formed across the entire surface of the passage-forming substrate 10, patterning is performed on the lead electrode 90 for each piezoelectric element 300, and the upper electrode film 80 on each piezoelectric element 300 and the drive circuit 16 are electrically connected through the connection hole 51.

Figure 5:
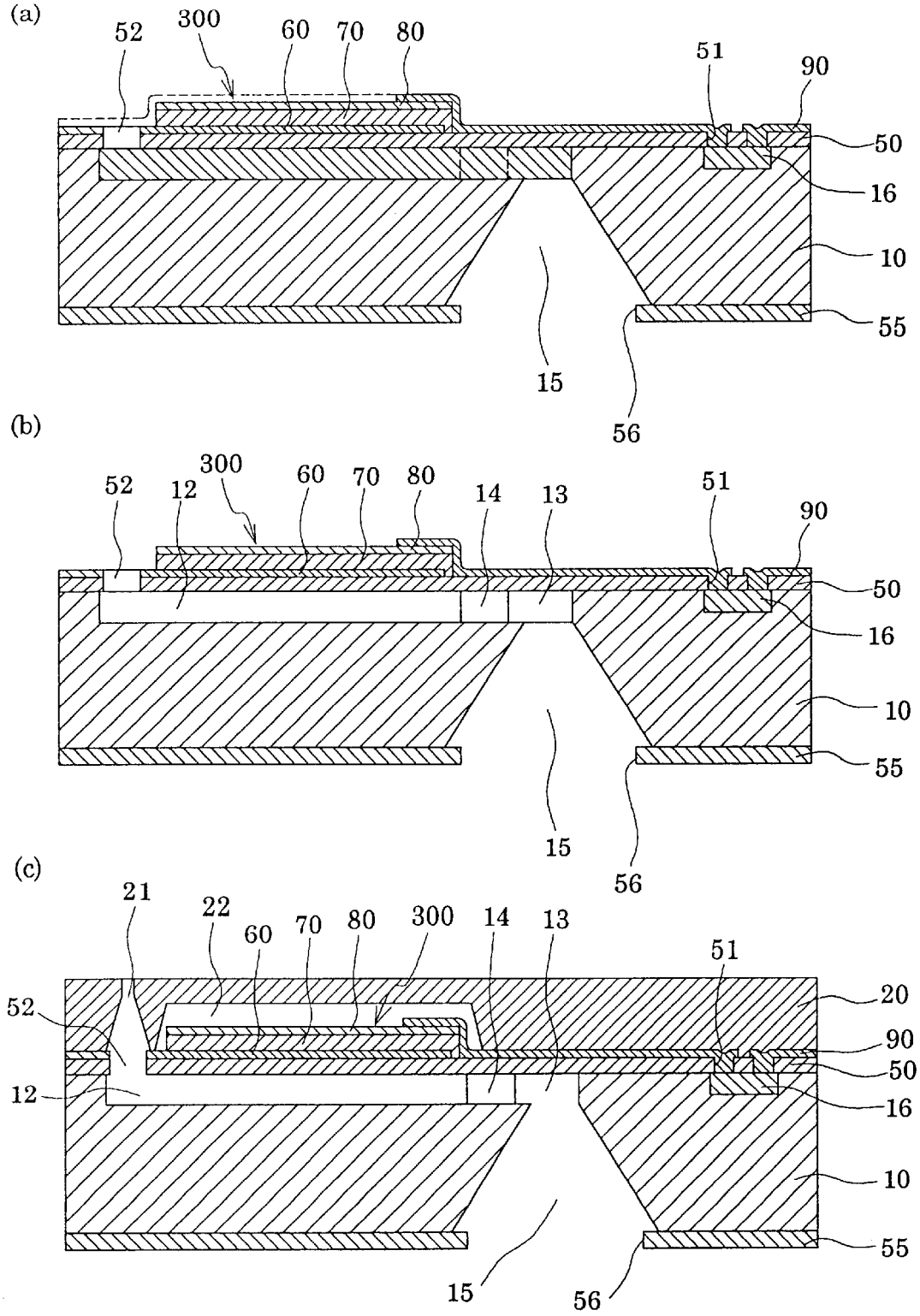
FIGS. 5(*a*) to 5(*c*) are cross-sectional views showing the manufacturing process of the ink-jet recording head according to embodiment 1 of the present invention.

As shown in FIG. 5(*a*), the region of the protective film 55, which is provided on the surface opposite the pressure generating chamber 12 of the passage-forming substrate 10 and becomes the reservoir 15, is removed by patterning to form an opening portion 56. And the anisotropic etching (wet etching) is performed until the etching reaches from the opening portion 56 to the ink communicating portion 13 to form the reservoir 15. Note that, in the present embodiment, the reservoir 15 is formed after the piezoelectric element 300 is formed. But, not being limited to this, the reservoir 15 may be formed by any process.

Next, as shown in FIG. 5(*b*), the sacrificial layer 100 is removed from the reservoir 15 by wet etching or etching by vapor. Because, in the present embodiment, PSG is used as a material of the sacrificial layer 100, etching is performed by hydrofluoric acid solution. When polysilicon is used, etching can be performed by a mixed solution of hydrofluoric acid and nitric acid or potassium hydroxide solution.

In the process as described above, the pressure generating chamber 12 and the piezoelectric element 300 are formed. Thereafter, as shown in FIG. 5(*c*), the nozzle plate 20 in which the nozzle orifices 21 are bored is fixed by adhesive agent or the like on the surface of the passage-forming substrate 10 where the piezoelectric elements 300 are formed.

In the ink-jet recording head as described above in the present embodiment, ink is introduced into the reservoir 15 from external ink supply means (not shown) and the entire inside from the reservoir 15 to the nozzle orifices 21 is filled with ink. Then, according to the recording signal from the drive circuit 16, a voltage is applied between the lower electrode films 60 and the upper electrode films 80 respectively corresponding to the pressure generating chambers 12, and the elastic film 50, the lower electrode film 60 and the piezoelectric layer 70 are made to have flexural distortion. Thus, the pressure in each pressure generating chamber 12 increases and the ink droplets are ejected from the nozzle orifices 21.

Figure 6:
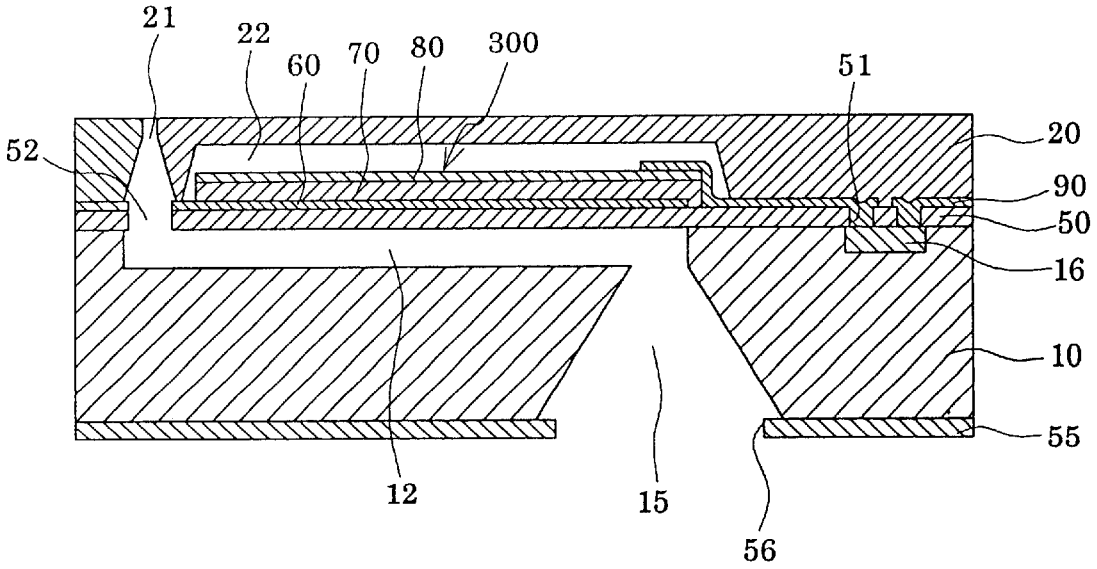
FIG. 6 is a cross-sectional view showing a variation example of the inkjet recording head according to embodiment 1 of the present invention.

Note that, in the present embodiment, each pressure generating chamber 12 and the reservoir 15 are made to communicate with each other through the ink communicating portion 13 and the narrowed portion 14. But, not being limited to this, as shown in FIG. 6, for example, each pressure generating chamber 12 and the reservoir 15 may be made to communicate directly with each other.

Figure 7:
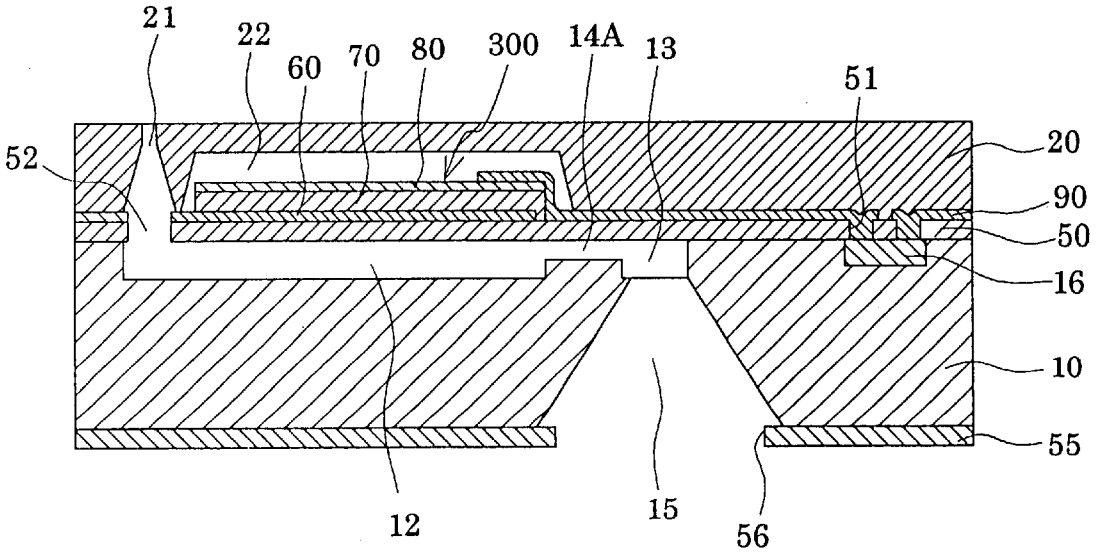
FIG. 7 is a cross-sectional view showing another variation example of the ink-jet recording head according to embodiment 1 of the present invention.

Also in the present embodiment, the narrowed portion 14 is formed in a width narrower than that of the pressure generating chamber 12 so as to control in and out flow of ink in the pressure generating chamber 12. But, not being limited to this, as shown in FIG. 7 for example, a narrowed portion 14A may be made so as to have the same width as that of the pressure generating chamber 12 and the depth adjusted.

(Embodiment 2)

Figure 8:
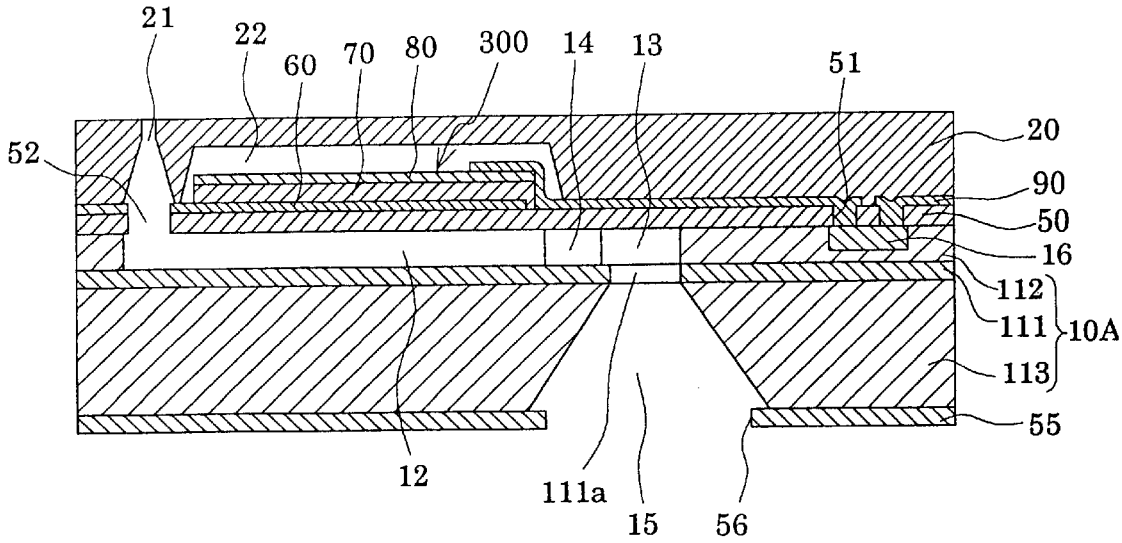
FIG. 8 is a cross-sectional view showing the ink-jet recording head according to embodiment 2 of the present invention.

FIG. 8 is a cross-sectional view of the ink-jet recording head according to embodiment 2.

The present embodiment is an example, in which a passage-forming substrate having a plurality of layers is used. As shown in FIG. 8, an SOI substrate that consists of an insulation layer 111 and first and second silicon layers 112 and 113 provided on both surfaces of the insulation layer 111 are used as a passage-forming substrate 10A.

Specifically, the constitution of this example is the same as embodiment 1 except for the following. Etching is performed on the first silicon layer 112, which has a film thickness thinner than that of the second silicon layer 113, until the etching reaches the insulation layer 111 to form the pressure generating chamber 12, the ink communicating portion 13 and the narrowed portion 14. Etching is performed for the second silicon layer 113 until the etching reaches the insulation layer 111 to form the reservoir 15, and then a penetrated portion 111*a* is formed at the portion of the insulation layer 111, which corresponds to the bottom surface of the reservoir 15.

In such a constitution of embodiment 2, of course, the same effect as that of the embodiment 1 can be obtained.

(Embodiment 3)

Figure 9:
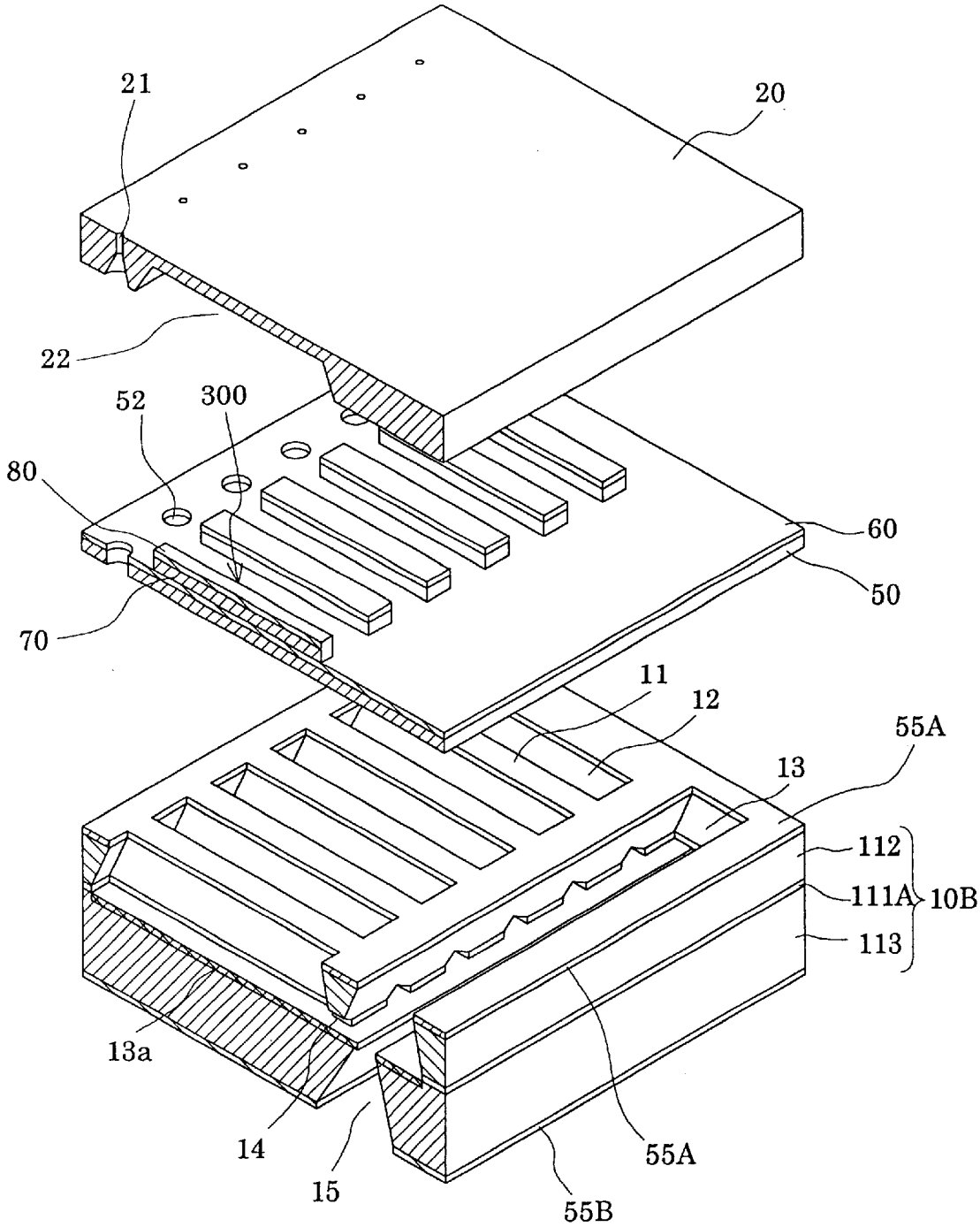
FIG. 9 is a perspective view showing an outline of the ink-jet recording head according to embodiment 3 of the present invention.
Figure 10:
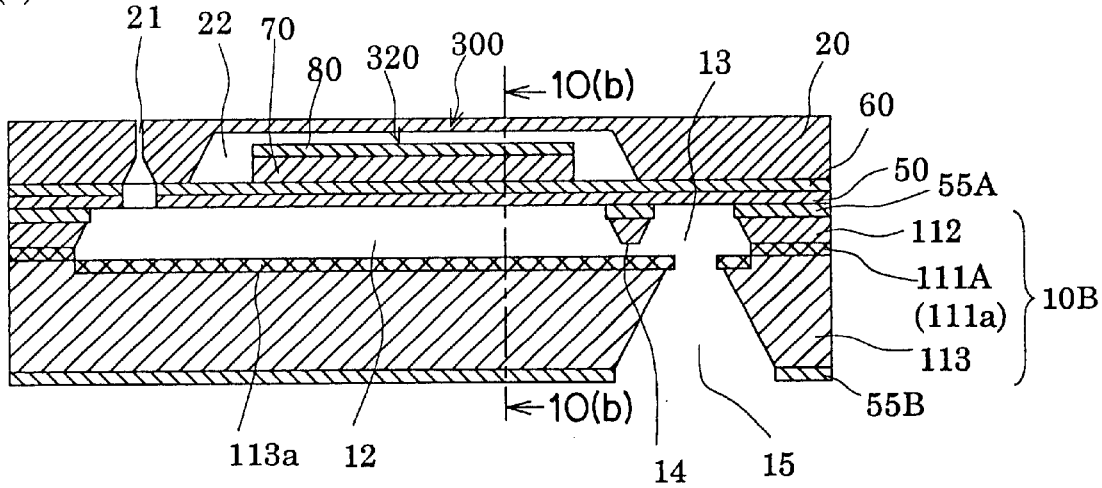
FIGS. 10(*a*) and 10(*b*) are cross-sectional views showing the ink-jet recording head according to embodiment 3 of the present invention.
Figure 10:
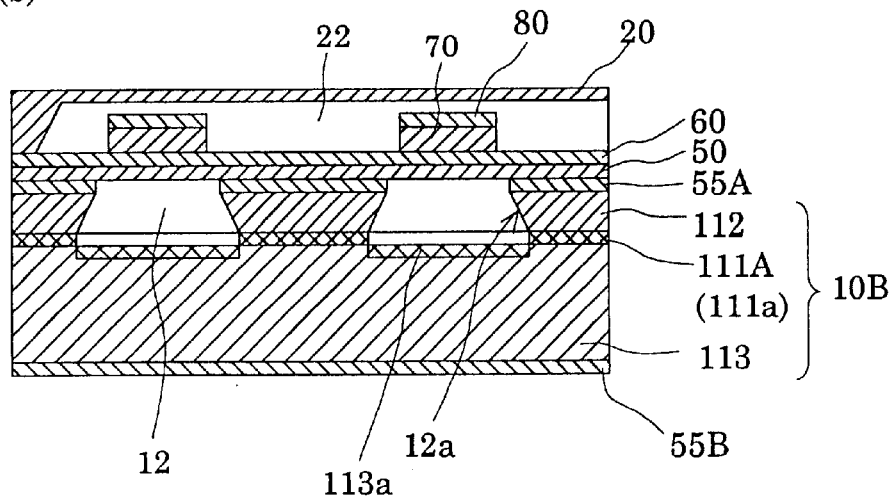

FIG. 9 is an exploded perspective view showing the ink-jet recording head according to embodiment 3. FIGS. 10(*a*) and 10(*b*) are cross-sectional views showing a cross-sectional structure in the longitudinal direction of one pressure generating chamber of the ink-jet recording head and an A–A' cross section thereof.

The present embodiment is another example, in which a passage-forming substrate constituted of a plurality of layers is used. As shown in the drawings, a passage-forming substrate 10B consists of a polysilicon layer 111A and first and second silicon layers 112 and 113 provided on both surfaces of the polysilicon layer 111A.

On one silicon layer constituting the passage-forming substrate 10B, which is the first silicon layer 112, for example, in the present embodiment, the pressure generating chambers 12 divided by a plurality of compartment walls 11 are parallelly provided in the width direction of the first silicon layer 112 by performing the anisotropic etching. On one end portion in the longitudinal direction of each pressure generating chamber 12, the ink communicating portion 13 is formed, and communicates with one end portion in the longitudinal direction of the pressure generating chamber 12 via a narrowed portion 14.

On the other silicon layer, which is the second silicon layer 113 in the present embodiment, the reservoir 15 penetrating the second silicon layer 113 in the thickness direction and communicating with the ink communicating portion 13 is formed. On the region opposing the pressure generating chamber 12, the ink communicating portion 13 and the narrowed portion 14, which is on the joining surface with the polysilicon layer 111A, and at the same time the region other than the portion where the reservoir 15 is made to communicate, a boron doped silicon layer 113*a* to which boron is doped is formed.

Each of the first and second silicon layers 112 and 113 constituting the passage-forming substrate 10B consists of a single crystal silicon substrate of a plane (100) of the plane orientation in the present embodiment. Therefore, the width direction side 12*a* of the pressure generating chamber 12 forms a slant surface that slants such that the width of the pressure generating chamber 12 becomes narrower closer to the surface where the piezoelectric element 300 is formed. Thus, the passage resistance in the pressure generating chamber 12 is controlled.

On the other hand, in the polysilicon layer 111A, which is supported so as to be sandwiched by the first and second silicon layers 112 and 113, in the present embodiment, the boron doped polysilicon layer 111*a* to which boron is doped in a specified region is formed. By the boron doped polysilicon layer 111*a,* the polysilicon layer 111A is made to have an etching selectivity of the pressure generating chamber 12 formed in the first silicon layer 112. In other words, substantially only the boron doped polysilicon layer 111*a* is supported so as to be sandwiched between the first and second silicon layers 112 and 113. Note that a silicon oxide layer may be provided between the polysilicon layer 111*a* and the first silicon layer 112, thus highly precise etching selectivity of the polysilicon layer 11*a* can be obtained.

On the surface of the first silicon layer 112 that constitutes the passage-forming substrate 10B, a protective film 55A formed by previously performing thermal oxidization for the first silicon layer 112 is formed. On the protective film 55A, similarly to the above-described embodiments, the piezoelectric element 300 that consists of the lower electrode film 60, the piezoelectric layer 70 and the upper electrode film 80 is formed via the elastic film 50.

Then, on the surface of the passage-forming substrate 10 where the piezoelectric element 300 is formed, on the elastic film 50 and the lower electrode film 60 in the present embodiment, the nozzle plate 20 is joined similarly to the above-described embodiments.

In such a constitution of embodiment 3, of course, the same effect as that of the above-described embodiments can be obtained.

In the present embodiment, each of the first and second silicon layers 112 and 113 constituting the passage-forming substrate 10B consists of a single crystal silicon substrate of a plane (100) of the plane orientation. Not being limited to this, they may be, for example, single crystal silicon substrates of a plane (100) of the plane orientation and a plane (110) of the plane orientation, or both layers may be a plane (110) of the plane orientation.

Figure 11:
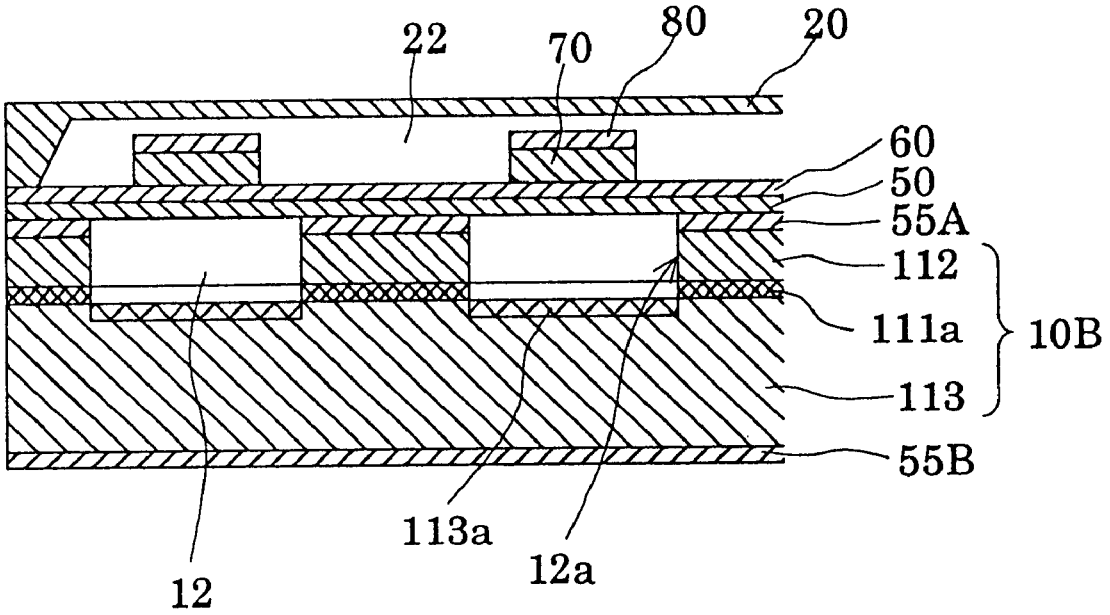
FIG. 11 is a cross-sectional view showing a variation example of the ink-jet recording head according to embodiment 3 of the present invention.

In the case where each of the first and second silicon layers 112 and 113 consists of a single crystal silicon substrate of a plane (110) of the plane orientation, as shown in FIG. 11, the inner surface (12*a*) of the pressure generating chamber 12, the ink communicating portion 13 and the narrowed portion 14 are formed of surfaces approximately perpendicular to the surface of the passage-forming substrate 10B. Also in the case of this constitution, the passage resistance of the narrowed portion 14 can be controlled by, for example, adjusting the width thereof.

In addition, the forming position of drive IC for driving the piezoelectric element 300 is not specifically limited. Similarly to the above-described embodiments, the drive IC may be provided integrally to the passage-forming substrate 10B or the nozzle plate 20.

(Embodiment 4)

Figure 12:
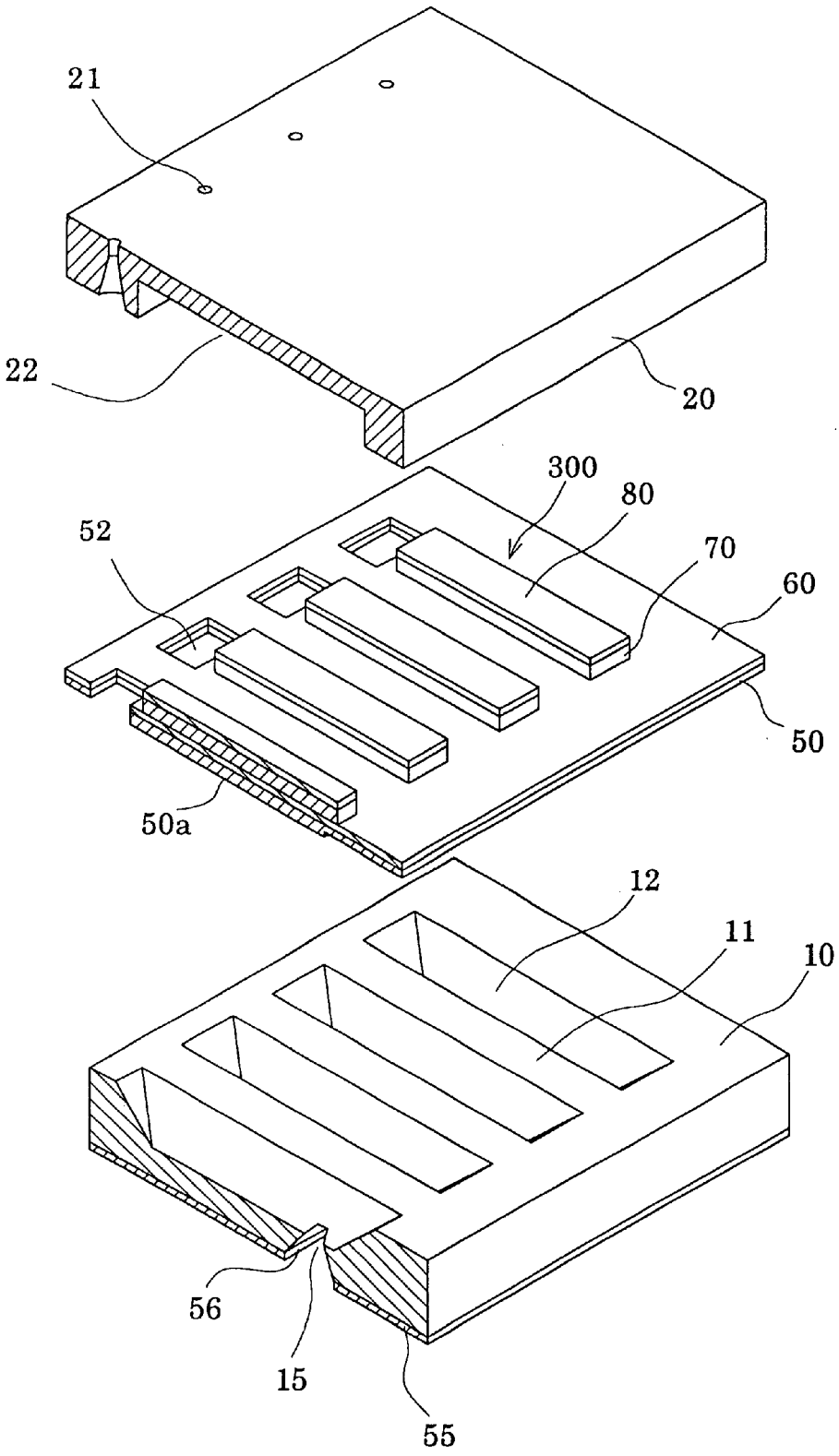
FIG. 12 is a perspective view showing an outline of the inkjet recording head according to embodiment 4 of the present invention.
Figure 13:
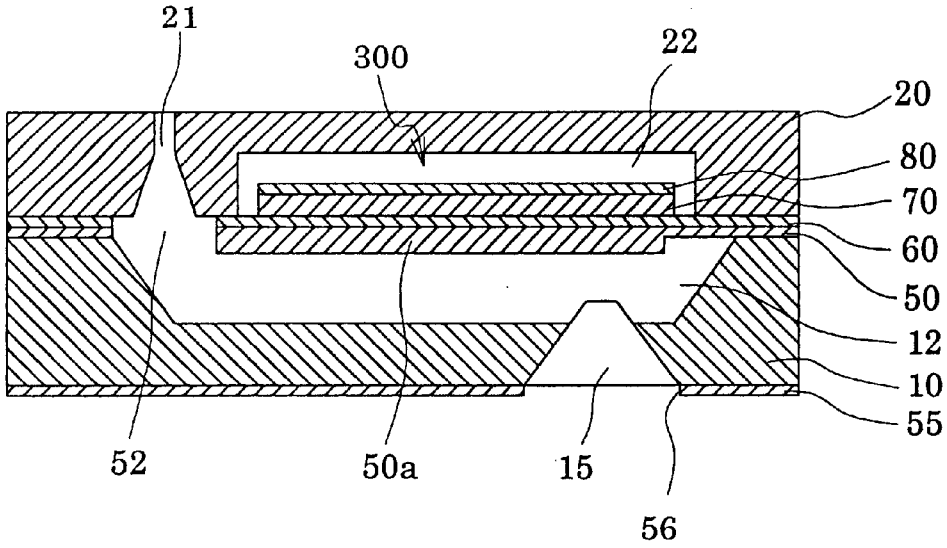
FIGS. 13(*a*) and 13(*b*) are cross-sectional views showing the inkjet recording head according to embodiment 4 of the present invention.
Figure 13:
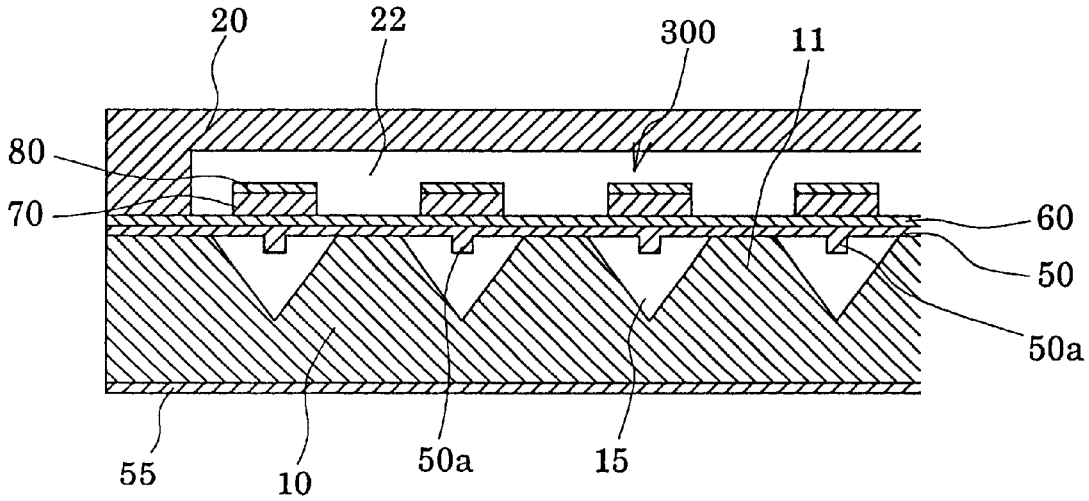

FIG. 12 is an exploded perspective view showing the ink-jet recording head according to embodiment 4. FIGS. 13(*a*) and 13(*b*) are cross-sectional views of FIG. 12.

The present embodiment is an example in which a single crystal silicon substrate having a plane (100) of the plane orientation is used as the passage-forming substrate 10 to form the pressure generating chamber 12 without using the sacrificial layer. As shown in the drawing, on one surface of the passage-forming substrate 10, the pressure generating chambers 12, which are divided by a plurality of compartment walls 11, and have sectional surfaces of an approximately triangular shape, are parallelly provided in the width direction. In the vicinity of one end portion in the longitudinal direction of the pressure generating chamber 12, the reservoir 15 that becomes the common ink chamber to each pressure generating chamber 12 is formed by performing the anisotropic etching from the other surface of the passage-forming substrate 10.

Also on the passage-forming substrate 10, the piezoelectric element 300 that consists of the lower electrode film 60, the piezoelectric layer 70 and the upper electrode film 80 is formed via the elastic film 50. In the present embodiment, a protrusion 50*a* protruding in the direction of the passage-forming substrate 10 is formed along the longitudinal direction of the pressure generating chamber 12 on the region of the elastic film 50, which is opposite each pressure generating chamber 12.

Then, on the surface of the passage-forming substrate 10 where the piezoelectric element 300 is formed, which is the elastic film 50 and the lower electrode film 60 in the present embodiment, the nozzle plate 20 is joined similarly to the above-described embodiments.

Herein, the manufacturing method of the ink-jet recording head of the present embodiment, particularly, the process of forming the pressure generating chamber 12 on the passage-forming substrate 10 will be described with reference to FIGS. 14(*a*) to 14(*f*) and FIGS. 15(*a*) to 15(*f*).

Figure 14:
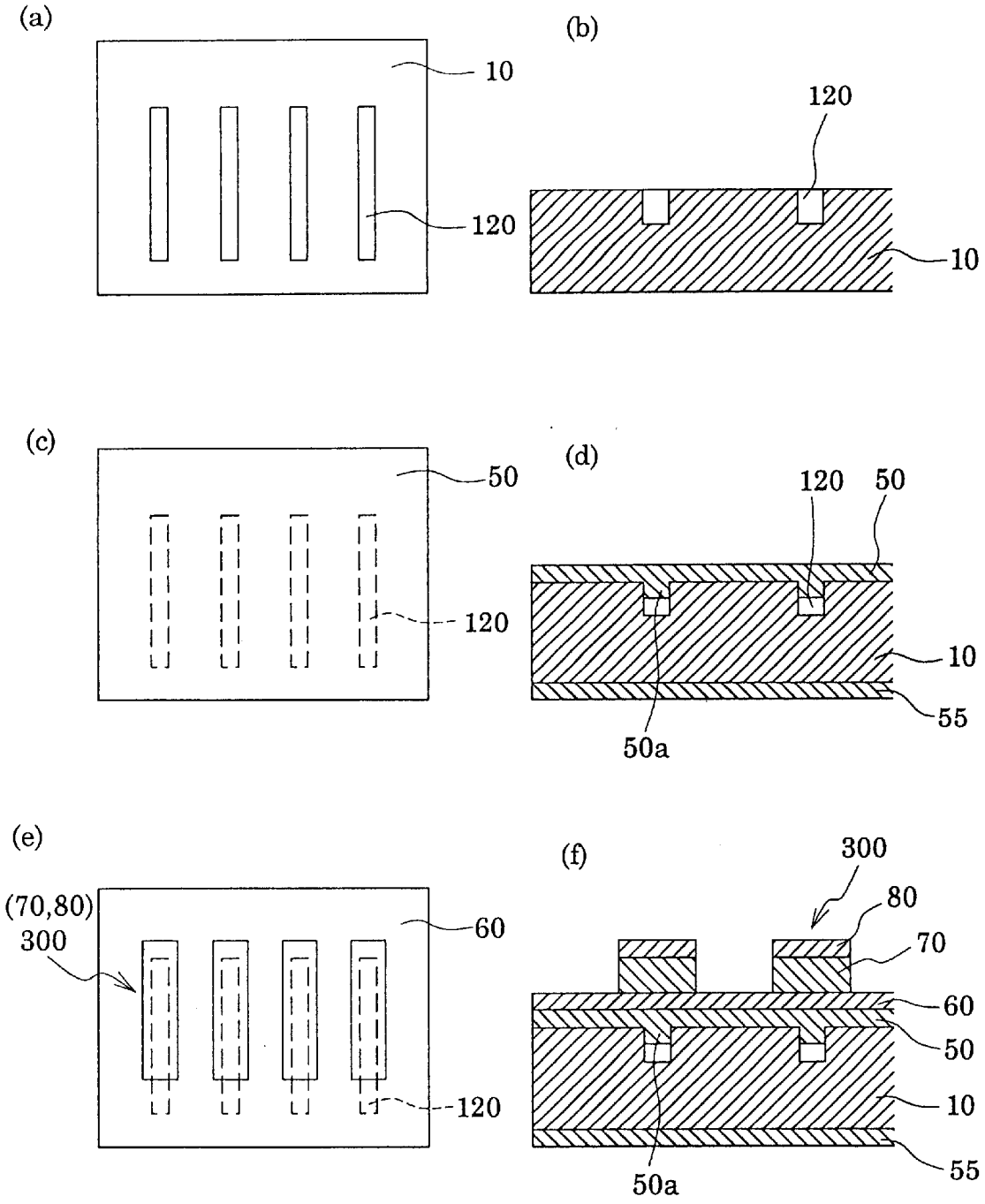
FIGS. 14(*a*) to 14(*f*) are cross-sectional views showing the manufacturing process of the ink-jet recording head according to embodiment 4 of the present invention.

Firstly, as shown in FIGS. 14(*a*) and 14(*b*), on the region where each pressure generating chamber 12 is formed, of the passage-forming substrate 10 that consists of a single crystal silicon substrate, a groove portion 120 of an approximately rectangular shape which has a depth of, for example, 50 to 100 $\mu$m is formed in a width narrower than that of the pressure generating chamber 12. Preferably, the width of the groove portion 120 is approximately 0.1 to 3 $\mu$m, and the groove portion 120 is formed in the width of approximately 1 $\mu$m in the present embodiment. Note that the forming method of the groove portion 120 is not specifically limited, and the groove portion may be formed by such as dry etching.

Next, as shown in FIGS. 14(*c*) and 14(*d*), the elastic film 50 and the protective film 55 are formed respectively on the both surfaces of the passage-forming substrate 10.

Herein, because a portion of the elastic film 50 formed on the surface of the passage-forming substrate 10 where the groove portion 120 is formed is formed so as to enter the groove portion 120, the protrusion 50*a* protruding in the direction of the passage-forming substrate 10, which has approximately the same shape as that of the groove portion 120, is formed in the region, which opposes each pressure generating chamber 12, of the elastic film 50.

Next, as shown in FIGS. 14(*e*) and 14(*f*), the lower electrode film 60, the piezoelectric layer 70 and the upper electrode film 80 are sequentially laminated and subjected to patterning to form the piezoelectric element 300.

Thereafter, the anisotropic etching is performed for the single crystal silicon substrate as the passage-forming substrate 10 by alkali solution or the like to form the pressure generating chamber 12 and the like.

Figure 15:
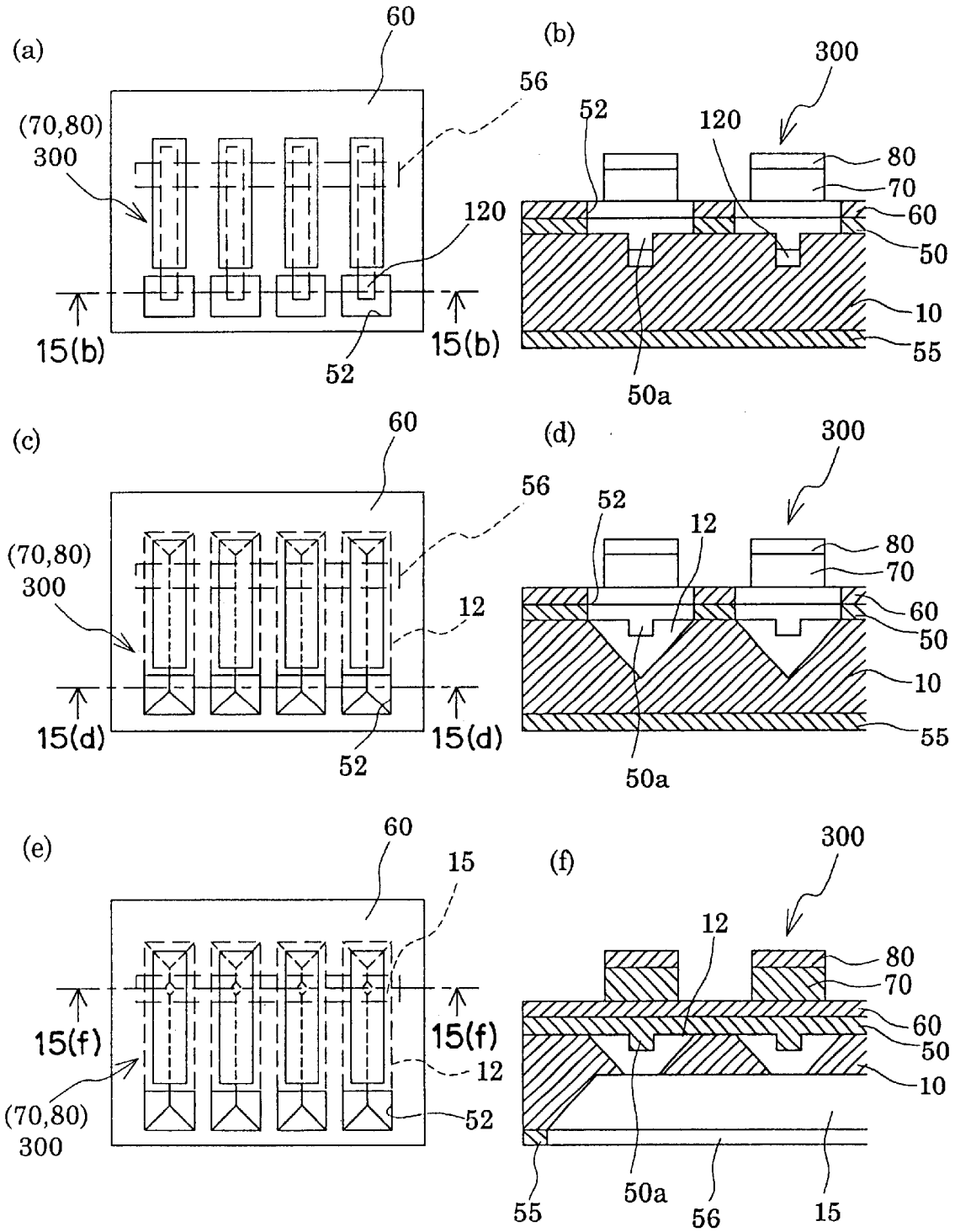
FIGS. 15(*a*) to 15(*f*) are cross-sectional views showing the manufacturing process of the ink-jet recording head according to embodiment 4 of the present invention.

In more detail, firstly, as shown in FIG. 15(*a*) and FIG. 15(*b*) which is a B–B' cross-sectional view of FIG. 15(*a*), the lower electrode film 60 and the elastic film 50 in the region that becomes one end portion in the longitudinal direction of each pressure generating chamber 12 are removed to form the nozzle communicating hole 52 that communicates with the nozzle orifice 21. Accordingly, the surface of the passage-forming substrate 10 and one end portion in the longitudinal direction of the groove portion 120 are exposed. At the same time, the protective film 55 in the region where the reservoir 15 is formed is removed to form an opening portion 56.

Thereafter, as shown in FIG. 15(*c*) and FIG. 15(*d*) which is a B–B' cross-sectional view of FIG. 15(*c*), anisotropic etching is performed for the passage-forming substrate 10 via the nozzle communicating hole 52 by alkali solution such as KOH to form the pressure generating chamber 12. Herein, in performing the anisotropic etching, the alkali solution flows into the groove portion 120 through the nozzle communicating hole 52, and the passage-forming substrate 10 is gradually eroded from the groove portion 120, thus the pressure generating chamber 12 is formed. Also, because the passage-forming substrate 10 is a single crystal silicon substrate of a plane (100) of the crystal plane orientation, the inner surface of the pressure generating chamber 12 is formed of a plane (111) that is slanted by approximately 54° to the surface of the passage-forming substrate 10. In other words, the plane (111) is a substantial bottom surface of the pressure generating chamber 12 and an etching stopping surface in performing the anisotropic etching, and the pressure generating chamber 12 is formed such that the lateral cross-sectional surface thereof becomes an approximately triangular shape.

After the pressure generating chamber 12 and the like are formed as described above, as shown in FIG. 15(*e*) and FIG. 15(*f*) which is a C–C' cross-sectional view of FIG. 15(*e*), etching is performed from the opposite surface with that of the passage-forming substrate 10 where the piezoelectric element 300 is formed by using the protective film 55 as a mask. In other words, the anisotropic etching is performed for the passage-forming substrate 10 via the opening portion 56, thus the reservoir 15 that communicates with the pressure generating chamber 12 is formed.

As described above, in the present embodiment, since the pressure generating chamber 12 is formed such that the lateral cross-sectional surface thereof becomes an approximately triangular shape, the rigidity of the compartment wall 11 between the pressure generating chambers 12 significantly increases. Therefore, cross talk does not occur even if the pressure generating chambers 12 are arranged in high density, thus the ink ejection characteristic can be excellently maintained.

Moreover, the pressure generating chamber 12 can be formed without penetrating the passage-forming substrate 10 by etching. Therefore, in the present embodiment, the thickness of the passage-forming substrate 10 is made to be approximately 220 $\mu$m, but the plate may be thicker. Accordingly, a wafer can be handled easily even if the size of the wafer, on which the passage-forming substrates 10 are formed, is made to be relatively large in diameter, and the manufacturing cost can be reduced.

In such a constitution of the present embodiment, of course, the same effect as that of the above-described embodiments can be obtained.

Figure 16:
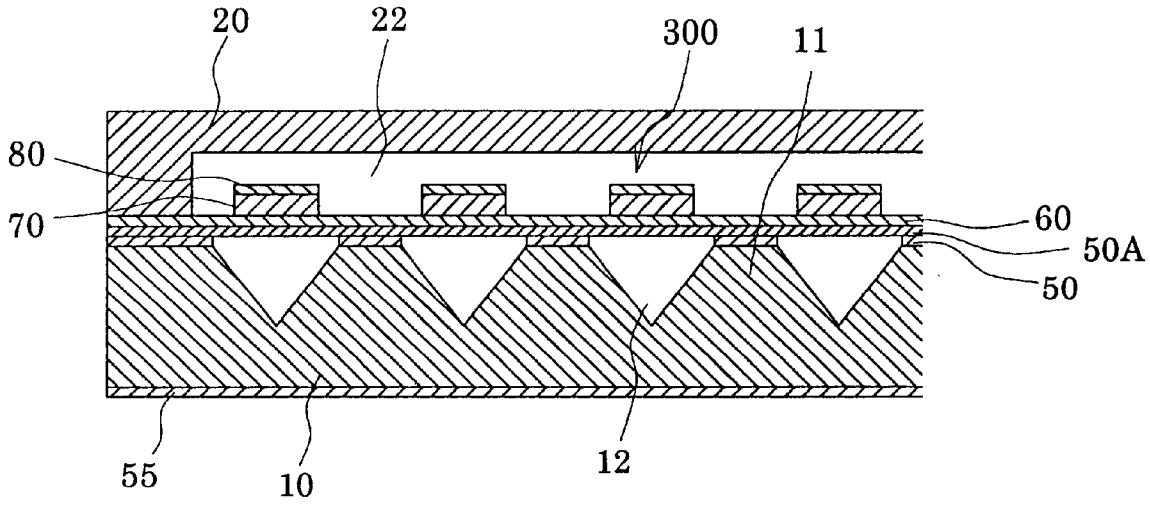
FIG. 16 is a cross-sectional view showing a variation example of the ink-jet recording head according to embodiment 4 of the present invention.

Incidentally, in the present embodiment, the protrusion 50*a* is formed in the portion, which corresponds to each pressure generating chamber 12, of the elastic film 50. The protrusion 50*a* may be removed, for example, at the same time when etching is performed for the pressure generating chamber 12. Moreover, as shown in FIG. 16, a second elastic film 50A that consists of zirconium oxide or the like is previously provided on the elastic film 50, and the elastic film 50 in the region opposite to the pressure generating chamber 12 may be completely removed when the pressure generating chamber 12 is formed by anisotropic etching.

(Embodiment 5)

Figure 17:
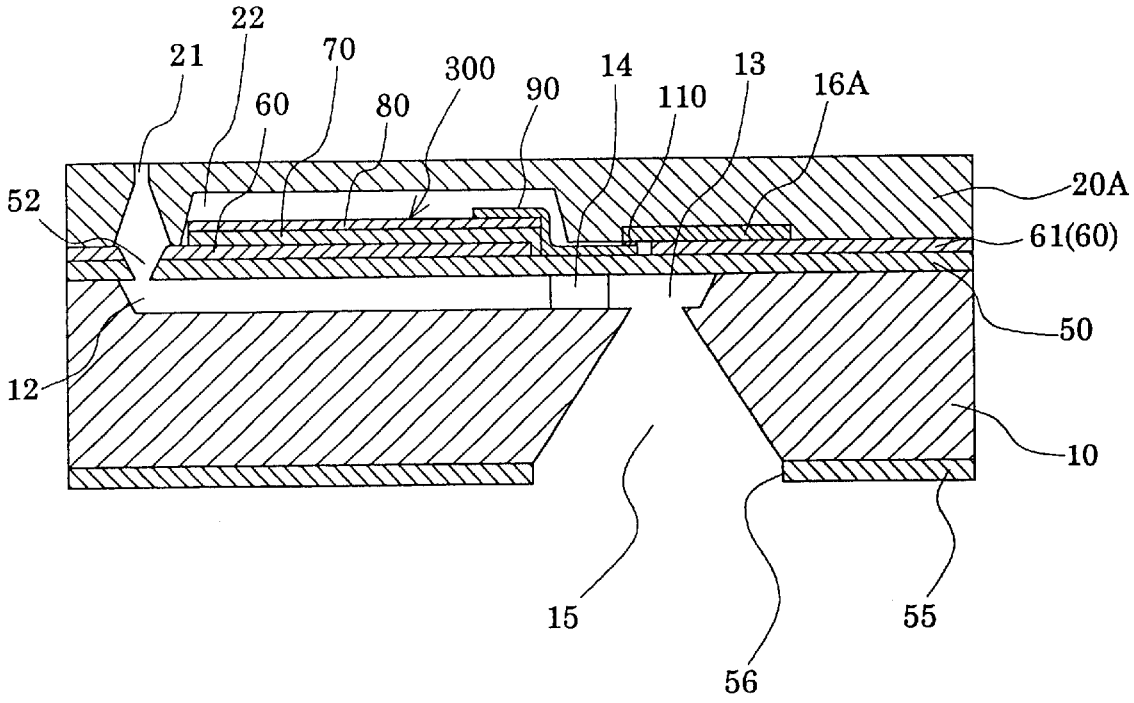
FIG. 17 is a cross-sectional view showing the ink-jet recording head according to embodiment 5 of the present invention.

FIG. 17 is a cross-sectional view of the ink-jet recording head according to embodiment 5.

The present embodiment is an example in which the drive circuit for driving the piezoelectric element is integrally provided in the nozzle plate. As shown in FIG. 17, in the region other than the piezoelectric element holding portion 22 of the nozzle plate 20A on the joining surface with the passage-forming substrate 10, which is in the vicinity of one end portion of the passage-forming substrate 10 in the present embodiment, the drive circuit 16A is integrally formed.

The drive circuit 16A and the upper electrode film 80 of the piezoelectric element 300 are connected via the lead electrode 90. For example in the present embodiment, the lead electrode 90 is provided so as to extend from the surface of the upper electrode film 80 to the vicinity of the noncontinuous lower electrode film 61, which is not continuous with the lower electrode film 60, on the surface of the elastic film 50. And, the end portion of the lead electrode 90 and the drive circuit 16A are electrically connected via a connection layer 110 that consists of an anisotropic conductive material (ACF) or the like. The constitution of this example is the same as that of the embodiment 1 except the above.

Figure 18:
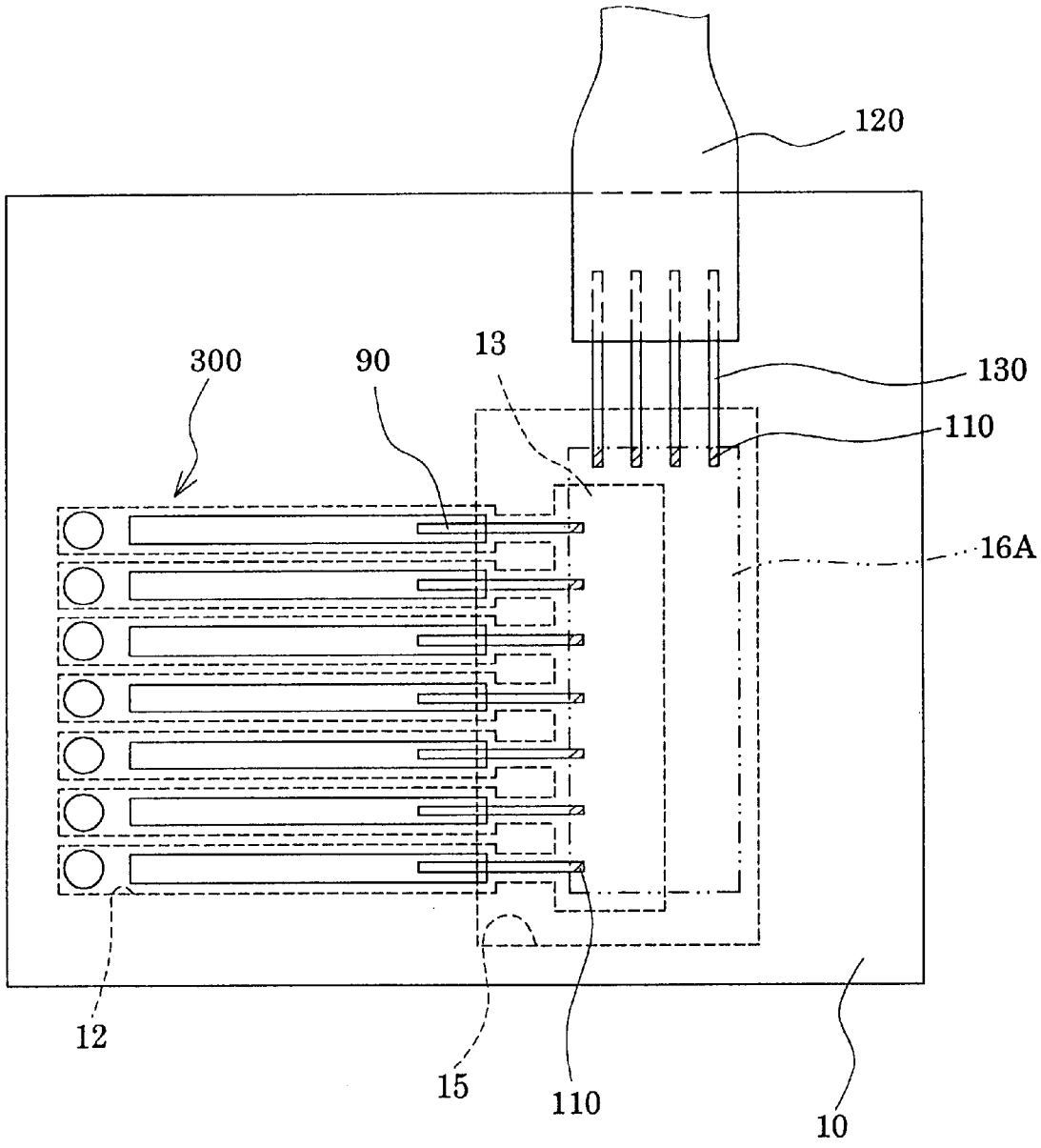
FIG. 18 is a top view showing an outline of the inkjet recording head according to embodiment 5 of the present invention.

Note that, in the present embodiment, as shown in FIG. 18, on the passage-forming substrate 10, connection wirings 130 that connect the drive circuit 16A and external wiring 120 such as FPC are formed in the vicinity of the end portion in the direction where the pressure generating chambers 12 are parallelly provided. The drive circuit 16A and the connection wirings 130 are electrically connected via the connection layer 110 similarly to the lead electrode 90 connected to the drive circuit 16A.

And, in such a constitution of the present embodiment, of course, the same effect as that of the above-described embodiments can be obtained. Further in the present embodiment, since the lead electrodes 90 and the connection wirings 130 can be connected with the drive circuit 16A by joining the nozzle plate 20 and the passage-forming substrate 10, the number of the connection wirings 130 can be reduced. Thus, the connection wirings can be taken out by such as FPC even if the nozzle orifices 21 are increased in number to be arranged in a high density.

Figure 19:
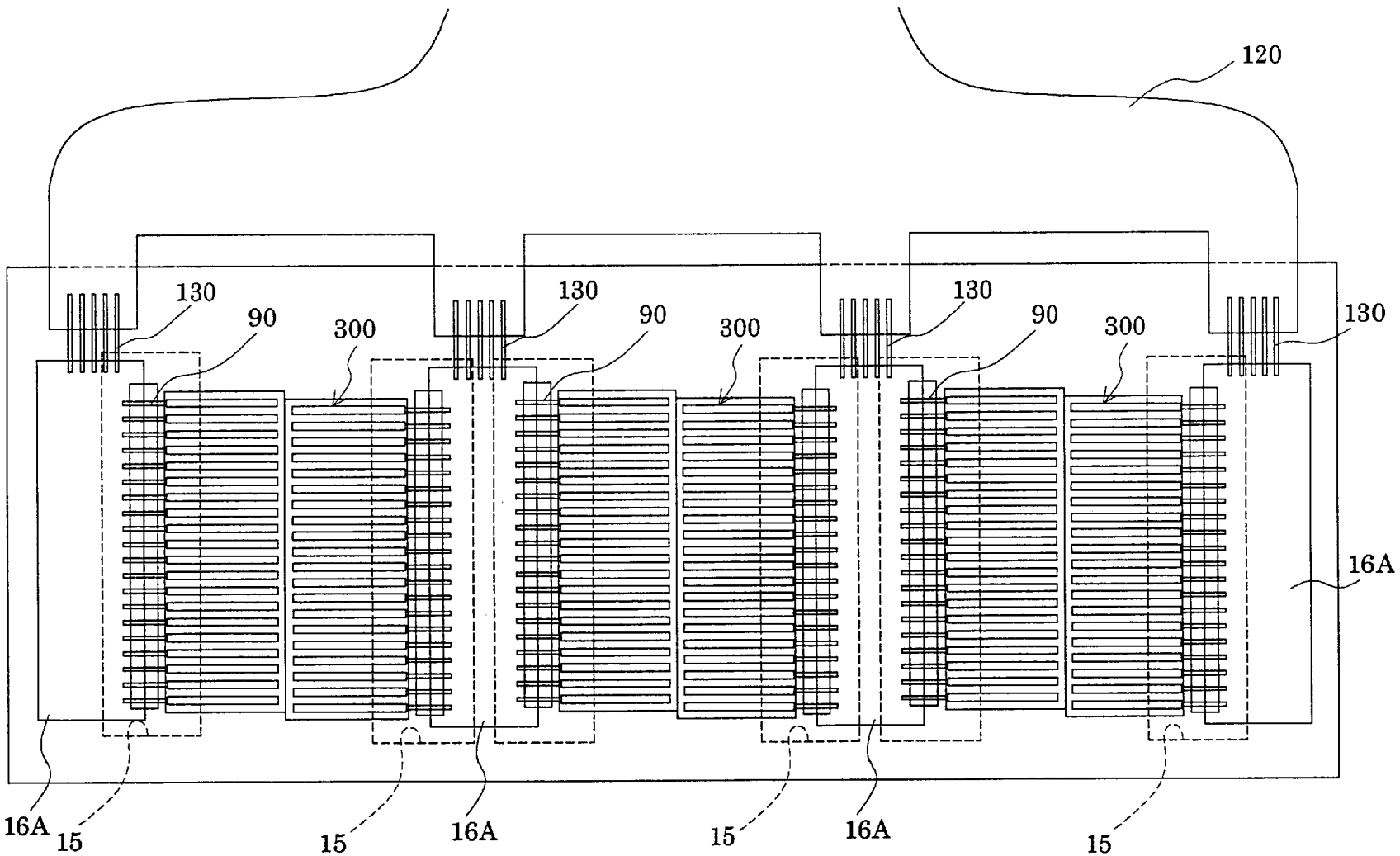
FIG. 19 is a top view showing a variation example of the ink-jet recording head according to embodiment 5 of the present invention.

For example as shown in FIG. 19, a plurality of the drive circuits 16A may be provided on a joining plate that is joined to the surface of the passage-forming substrate 10 where the piezoelectric elements 300 are formed, and arrays of the pressure generating chambers 12 and the piezoelectric elements 300 may be provided on the regions that correspond to both sides of the drive circuit 16A on the passage-forming substrate 10. In such a constitution, wirings from the piezoelectric elements 300 arranged in a high density can be easily taken out by the external wirings 120 such as FPC.

OTHER EMBODIMENTS

Although the embodiments of the present invention have been described above, the fundamental constitution of the inkjet recording head is not limited to the above-described embodiments.

For example in the above-described embodiments, the drive circuit 16 or 16A for driving the piezoelectric element 300 is integrally provided on the passage-forming substrate 10 or the nozzle plate 20A. Instead, the drive circuit may be separately provided in the vicinity of the passage-forming substrate 10, and electrically connected to the piezoelectric element 300 by a wire bonding or the like.

Figure 20:
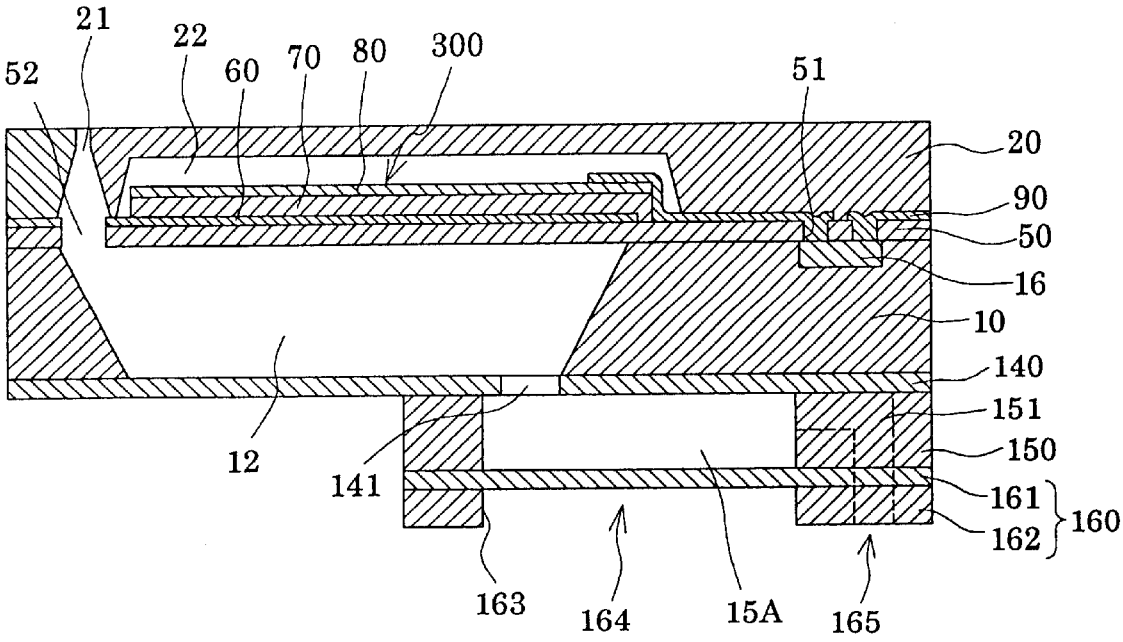
FIG. 20 is a cross-sectional view showing the inkjet recording head according to another embodiment of the present invention.

Also, for example in the above-described embodiments, the example has been described, in which the pressure generating chamber is formed without penetrating the passage-forming substrate. However, the pressure generating chamber may be naturally formed so as to penetrate the passage-forming substrate. FIG. 20 shows an example thereof.

In the embodiment, as shown in FIG. 20, a sealing plate 140 is joined on the surface opposite with that of the passage-forming substrate 10 where the piezoelectric elements 300 are formed, and one surface of the pressure generating chamber 12 is formed of the sealing plate 140. Moreover, a reservoir forming plate 150 where the reservoir 15A for supplying ink to the pressure generating chamber 12, is formed is joined under the sealing plate 140. The pressure generating chamber 12 and the reservoir 15A are made to communicate with each other via a penetrating hole 141 provided in the region of the sealing plate 140, which opposes the pressure generating chamber 12.

In addition, a compliance plate 160 that consists of a sealing film 161 and a fixing plate 162 is joined to the reservoir forming plate 150. The sealing film 161 consists of a material having a low rigidity and flexibility, and one surface of the reservoir 15A is sealed by the sealing film 161. The fixing plate 162 consists of a hard material such as metal. Since the region of the fixing plate 162 opposite the reservoir 15A is completely removed in the thickness direction to be an opening portion 163, one surface of the reservoir 15A is sealed by only the sealing film 161 having flexibility to form a flexible portion 164 capable of being deformed by a change of the inner pressure.

Note that, an ink introducing port 165 for supplying ink to the reservoir 15A is formed on the compliance plate 160 outside the center portion approximately in the longitudinal direction of the reservoir 15A. An ink introducing path 151 that communicates with the ink introducing port 165 and the sidewall of the reservoir 15A is provided in the reservoir forming plate 150.

In addition, in the foregoing embodiments, a thin film type inkjet recording head, which is manufactured by applying a deposition process and a lithography process, has been exemplified. However, the ink-jet recording head is not limited to this type. The present invention can be adopted for a thick film type ink-jet recording head, which is formed by a method such as adhering a green sheet.

Figure 21:
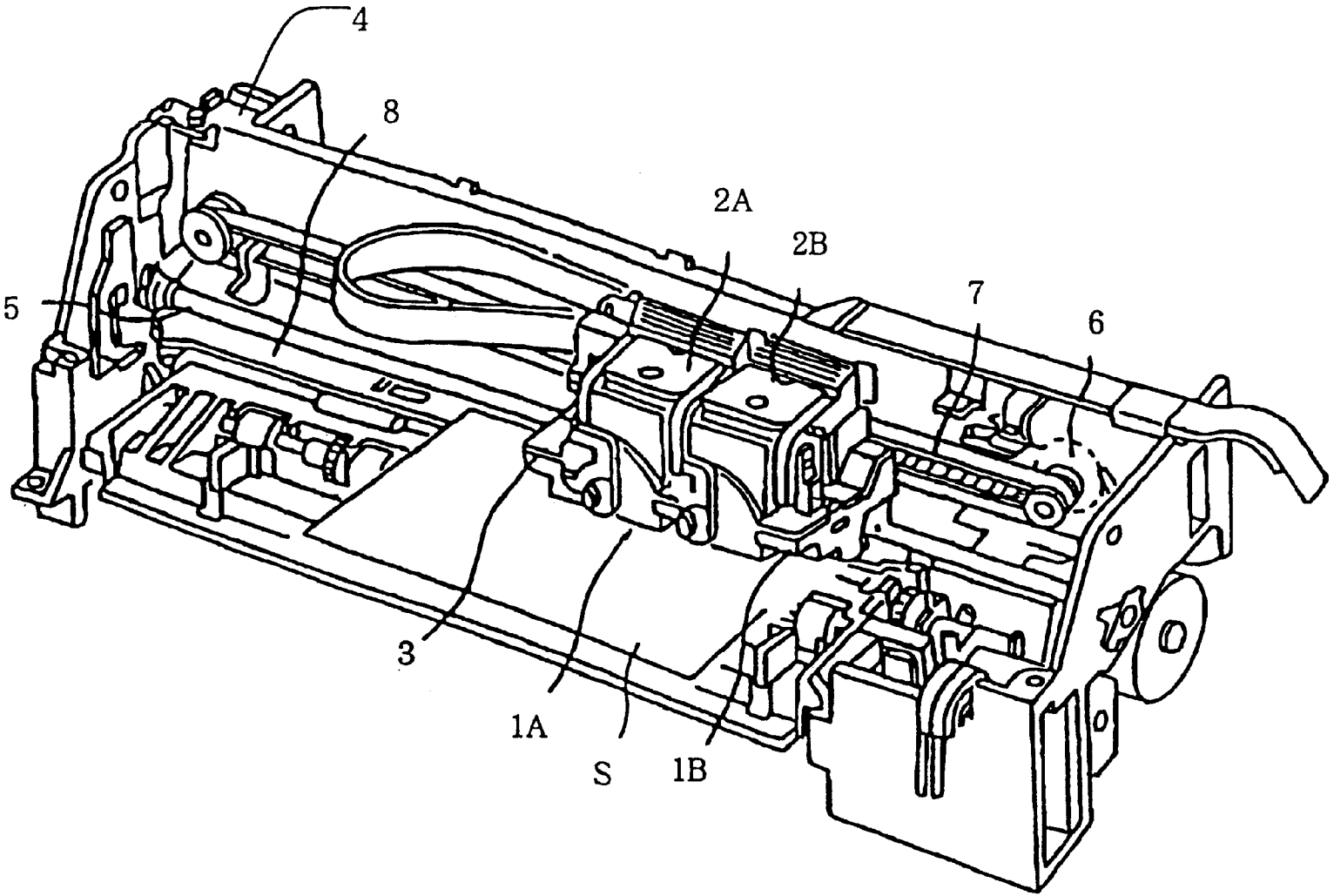
FIG. 21 is a schematic view of the inkjet recording apparatus according to one embodiment of the present invention.

The ink-jet recording head of the embodiments constitutes a portion of a recording head unit including an ink passage, which communicates with an ink cartridge or the like, and is mounted on the ink-jet recording apparatus. FIG. 21 is a schematic view showing an example of the ink-jet recording apparatus.

As shown in FIG. 21, in recording units 1A and 1B which have the ink-jet recording heads, cartridges 2A and 2B, which constitute ink supplying means, are provided detachably. A carriage 3 having the recording head units 1A and 1B mounted thereon is provided on a carriage shaft 5 attached on an apparatus body 4 so as to be freely movable, in the shaft direction. Each of the recording head units 1A and 1B is to eject a black ink composition and a color ink composition.

The drive force of the drive motor 6 is transmitted to the carriage 3 via a plurality of gears (not shown) and a timing belt 7 to move the carriage 3 that mounts the recording head units 1A and 1B along the carriage shaft 5. On the other hand, a platen 8 is provided to the apparatus body 4 along the carriage shaft 5, and a recording sheet S that is a recording medium such as paper fed by a paper feeding roller (not shown) is rolled and caught by the platen 8 to be conveyed.

As described above, in the present invention, since the nozzle orifice is provided on the joining plate that is provided on the surface of the passage-forming substrate where the piezoelectric element is formed, the pressure generating chamber may be formed without penetrating the passage-forming substrate. Therefore, since the pressure generating chamber can be formed relatively shallowly, the rigidity of the compartment wall dividing the pressure generating chambers can be improved. Thus, a plurality of the pressure generating chambers can be arranged in a high density. Moreover, since the joining plate serves a plurality of roles, the number of parts can be reduced and the cost also can be reduced.

Although the preferred embodiments of the present invention have been described in detail, it should be understood that various changes, substitutions and alternations can be made therein without departing from the spirit and scope of the invention as defined by the appended claims.

What is claimed is:

1. An ink-jet recording head comprising:

a passage-forming substrate comprising at least a silicon layer that consists of single crystal silicon and pressure generating chambers defined thereon, which communicate with a nozzle orifice; and a piezoelectric element for generating a pressure change in said pressure generating chamber, the piezoelectric element being provided in a region opposite said pressure generating chamber via a vibration plate, which constitutes a portion of said pressure generating chamber, wherein the ink-jet recording head further comprises a joining plate joined to said passage-forming substrate on the surface where said piezoelectric element is formed, and said nozzle orifice is provided on said joining plate.

2. The ink-jet recording head according to claim 1, wherein an integrated circuit is formed on said joining plate.

3. The inkjet recording head according to claim 2, wherein said integrated circuit is a drive circuit for driving said piezoelectric element.

4. The ink-jet recording head according claim 2, wherein said integrated circuit is temperature detecting means for detecting the temperature of a head or a temperature control circuit for controlling said temperature.

5. The ink-jet recording head according to claim 2, wherein said integrated circuit is ejection number detecting means for detecting the ejection number of ink droplets that are ejected from said nozzle orifices.

6. The ink-jet recording head according to claim 2, wherein said integrated circuit is provided on the surface opposite the joining surface of said joining plate with said passage-forming substrate.

7. The ink-jet recording head according to claim 2, wherein said integrated circuit is provided on the joining surface of said joining plate with said passage-forming substrate, and said piezoelectric element and said integrated circuit are electrically connected by flip chip mounting.

8. The ink-jet recording head according to claim 7, wherein connection wiring is formed on said passage-forming substrate to connect said integrated circuit and external wiring, and said integrated circuit and said connection wiring are electrically connected by flip chip mounting.

9. The ink-jet recording head according to claim 7, wherein said integrated circuit and said piezoelectric element or said connection wiring are connected by an anisotropic conductive material.

10. The ink-jet recording head according to claim 1, wherein said joining plate is a sealing plate that includes a piezoelectric element holding portion capable of sealing a space in a state where the space is secured for said piezoelectric element such that the movement thereof is not interfered with, in a region opposite to said piezoelectric element.

11. The ink-jet recording head according to claim 10, wherein said integrated circuit is a humidity control circuit for performing control of the humidity detecting means for detecting humidity of said piezoelectric element holding portion.

12. The ink-jet recording head according to claim 1, wherein said joining plate consists of a single crystal silicon substrate.

13. The ink-jet recording head according to claim 1, wherein said pressure generating chamber is formed on one surface of said passage-forming substrate without penetrating the passage-forming substrate, and a reservoir for supplying ink to said pressure generating chamber is formed on the other surface of said passage-forming substrate.

14. The ink-jet recording head according to claim 13, wherein said reservoir directly communicates with said pressure generating chamber.

15. The ink-jet recording head according to claim 13, wherein an ink communicating path communicating with one end portion in the longitudinal direction of said pressure generating chamber is formed on one surface of said passage-forming substrate, and said reservoir communicates with said ink communicating path.

16. The ink-jet recording head according to claim 15, wherein said ink communicating path is provided for each pressure generating chamber.

17. The ink-jet recording head according to claim 15, wherein said ink communicating path is continuously provided across the direction where said pressure generating chambers are parallelly provided.

18. The ink-jet recording head according to claim 13, wherein a nozzle communicating path communicating said pressure generating chamber with said nozzle orifice is provided at the end portion opposite said reservoir in the longitudinal direction of said pressure generating chamber.

19. The ink-jet recording head according to claim 18, wherein said nozzle communicating path is formed by removing said vibration plate.

20. The ink-jet recording head according to claim 18, wherein the inner surface of said nozzle communicating path is covered with adhesive agent.

21. The inkjet recording head according to claim 1, wherein said passage-forming substrate consists only of said silicon layer.

22. The ink-jet recording head according to claim 1, wherein said passage-forming substrate consists of an SOI substrate having silicon layers on both surfaces of an insulation layer.

23. The ink-jet recording head according to claim 1, wherein said passage-forming substrate consists of a substrate having at least silicon layers on both surfaces of a boron doped polysilicon layer.

24. The ink-jet recording head according to claim 1, wherein the plane orientation of the silicon layer that consists of said passage-forming substrate is a (100) plane.

25. The ink-jet recording head according to claim 24, wherein the lateral cross-sectional surface of said pressure generating chamber has an approximately triangular shape.

26. The ink-jet recording head according to claim 1, wherein said pressure generating chamber is formed by anisotropic etching, and each layer constituting said vibration plate and said piezoelectric element is formed by a deposition and lithography method.

27. An ink-jet recording apparatus comprising the ink-jet recording head according to claim 1.

* * * * *